US010950112B2

(12) United States Patent
Ten Kate

(10) Patent No.: US 10,950,112 B2
(45) Date of Patent: Mar. 16, 2021

(54) WRIST FALL DETECTOR BASED ON ARM DIRECTION

(71) Applicant: KONINKLIJKE PHILIPS N.V., Eindhoven (NL)

(72) Inventor: Warner Rudolph Theophile Ten Kate, Waarle (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/651,858

(22) PCT Filed: Sep. 26, 2018

(86) PCT No.: PCT/EP2018/076038

§ 371 (c)(1),
(2) Date: Mar. 27, 2020

(87) PCT Pub. No.: WO2019/063576

PCT Pub. Date: Apr. 4, 2019

(65) Prior Publication Data

US 2020/0258365 A1 Aug. 13, 2020

Related U.S. Application Data

(60) Provisional application No. 62/565,303, filed on Sep. 29, 2017.

(51) Int. Cl.
*G08B 21/04* (2006.01)

(52) U.S. Cl.
CPC ..... *G08B 21/0446* (2013.01); *G08B 21/043* (2013.01)

(58) Field of Classification Search
None
See application file for complete search history.

(56) References Cited

U.S. PATENT DOCUMENTS

| | | | | |
|---|---|---|---|---|
| 2009/0322540 | A1 | 12/2009 | Parker | |
| 2012/0259577 | A1 | 10/2012 | Ganyi | |
| 2014/0150530 | A1* | 6/2014 | Ten Kate | G08B 21/043 73/37 |
| 2014/0156216 | A1 | 6/2014 | Ten Kate | |
| 2014/0375461 | A1* | 12/2014 | Richardson | A61B 5/681 340/573.7 |
| 2015/0317890 | A1 | 11/2015 | Ten Kate | |

FOREIGN PATENT DOCUMENTS

| | | | |
|---|---|---|---|
| CN | 104408877 | A | 3/2015 |
| WO | 2014147496 | A1 | 9/2014 |
| WO | 2015028283 | A1 | 3/2015 |

OTHER PUBLICATIONS

International Search Report and Written Opinion, International Application No. PCT/EP2018/076038, dated Dec. 12, 2018.

* cited by examiner

*Primary Examiner* — Adolf Dsouza

(57) ABSTRACT

A fall detection apparatus detects when a suspected fall event has occurred based on receipt of arm direction information. The fall detection apparatus provides further discrimination of when events involving a subject are suspected fall events.

15 Claims, 8 Drawing Sheets

WRIST FALL DETECTOR BASED ON ARM DIRECTION

CROSS-REFERENCE TO PRIOR APPLICATIONS

This application is the U.S. National Phase application under 35 U.S.C. § 371 of International Application No. PCT/EP2018/076038, filed on 26 Sep. 2018, which claims the benefit of U.S. Provisional Patent Application No. 62/565,303, filed on 29 Sep. 2017. These applications are hereby incorporated by reference herein.

FIELD OF THE INVENTION

The present invention is generally related to fall detection, and in particular, fall detection using wrist sensor devices.

BACKGROUND OF THE INVENTION

Fall detection systems are challenged in the pursuit of low False Alarm (FA) rates. While technically a FA rate on the order of 1 alarm per day (per user) is a reasonable result, for many users, this rate is still too high and may cause enough annoyance to the user that he or she may choose not to wear the detector. One problem in fall detection is the inability to distinguish signals induced by ordinary movements during daily life from those induced by all possible movements that happen during a fall. In detection theory, sensitivity expresses how well the detector captures all falls, while specificity expresses how well non-falls are not turned into (false) alarms. For practical applications, however, the incident rate of such critical movements (movements inducing a FA) is also of relevance. The experienced FA-rate is the product of the specificity and the incident rate.

A very effective feature to keep track of in fall detection is the height change during the event. A height drop on the order of 50-100 cm (downwards) is typical for a fall. Height change can be estimated by using air pressure sensors. Another way to detect a fall is to estimate the height change from an accelerometer, using double integration. This latter method, however, is challenged in that it is more complicated to obtain high accuracy in the estimate. Fusion with a gyroscope may help to improve the accuracy.

When designing fall detectors using wrist-located sensors, additional challenges are borne from the fact that a wrist worn sensor experiences a much broader spectrum of daily movements, a set of movements that happen more often during a day, while the set of possible wrist movements during a fall is also broadened. For example, lifting the arm (e.g., to take something from a cupboard, or to scratch the head) and dropping the arm down (e.g., letting the arm fall against chair, or on a table or desk) provide sensor signals that look like a fall (height change, impact), while the movement is obviously not a fall. U.S. Patent Publication No. 20090322540 (hereinafter, "the '540 Pub.") describes an FM communicator that may be attached to the wrist (see, e.g., of the '540 Pub.) and that includes accelerometers and pressure sensors (see, e.g., [0037] of the '540 Pub.). The FM communicator may detect and determine an orientation (or position) and/or movement patterns of the user (see, e.g., [0036] of the '540 Pub.). In particular, based on the monitoring, the FM communicator may generate orientation data, translation movement data, rotational movement data, height data, height change data, time data, date data, location data, biometrics data, and the like, and store the data as fall condition data in an internal storage device. The fall condition data may be analyzed and detected for a fall event or other body orientation condition (see, e.g., [0048] of the '540 Pub.). The '540 Pub. discloses that various inertial features may be measured on the wrists that are likely to be useful in detecting and discriminating falls and near-falls from activities of daily living (see, e.g., [0049] of the '540 Pub.). Equations in paragraphs [0050] of the '540 Pub. disclose determining velocity at the wrist. The '540 Pub. appears to take measures to discriminate from activities of daily living and fall events, and the velocity measurements at the wrist appear to be used to detect and/or discriminate falls. Additional measures are desired to further discriminate falls from non-falls while maintaining simplicity in design.

SUMMARY OF THE INVENTION

One object of the present invention is to develop a fall detection system that uses arm direction in detecting a fall event. To better address such concerns, in a first aspect of the invention, a fall detection apparatus is presented that receives arm direction information and uses that information to determine whether an event involving a subject is a suspected fall event. The invention provides further discrimination in deciding if a subject is encountering a suspected fall event, which triggers additional processing to further validate the presence of a fall event before issuing an alert, which helps to reduce false alarm rates and encourage continual use of the apparatus.

In one embodiment, the fall detection apparatus is configured to determine the event involving the subject is a suspected fall event based at least on the arm direction information before and after the suspected fall event. By using the arm direction measurements before and after the event, the fall detection apparatus can remove, or at least mitigate the use of, arm movements that are commonly attributed to ordinary every day movements while effectively causing a wrist worn sensor to operate with similar accuracy as a body mounted sensor while reducing the incidence of false alarms engendered by ordinary arm movements.

In one embodiment, the fall detection apparatus comprises a processing circuit configured to determine a change in direction of the arm based on the arm direction information. The determination of a change in arm direction is helpful in circumstances where a subject falls while holding a bar, chair or walk-assist apparatus, wherein the wrist (and hence wrist worn sensor) remains at essentially the same height. Without arm direction information (e.g., change in direction), the detection of the fall event may be obscured.

In another embodiment, the fall detection apparatus is configured to receive additional information, wherein the processing circuit is further configured to execute instructions to derive height information for the wrist from the additional information and to determine a height change of the wrist corrected for a direction of an arm of the subject before and after a suspected fall event based on received signals. The use of arm direction information to correct the height information enables the fall event to be assessed more like a torso-based sensing system, which may result in fewer false alarms.

These and other aspects of the invention will be apparent from and elucidated with reference to the embodiment(s) described hereinafter.

BRIEF DESCRIPTION OF THE DRAWINGS

Many aspects of the invention can be better understood with reference to the following drawings, which are diagrammatic. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF EMBODIMENTS

Figure 1:
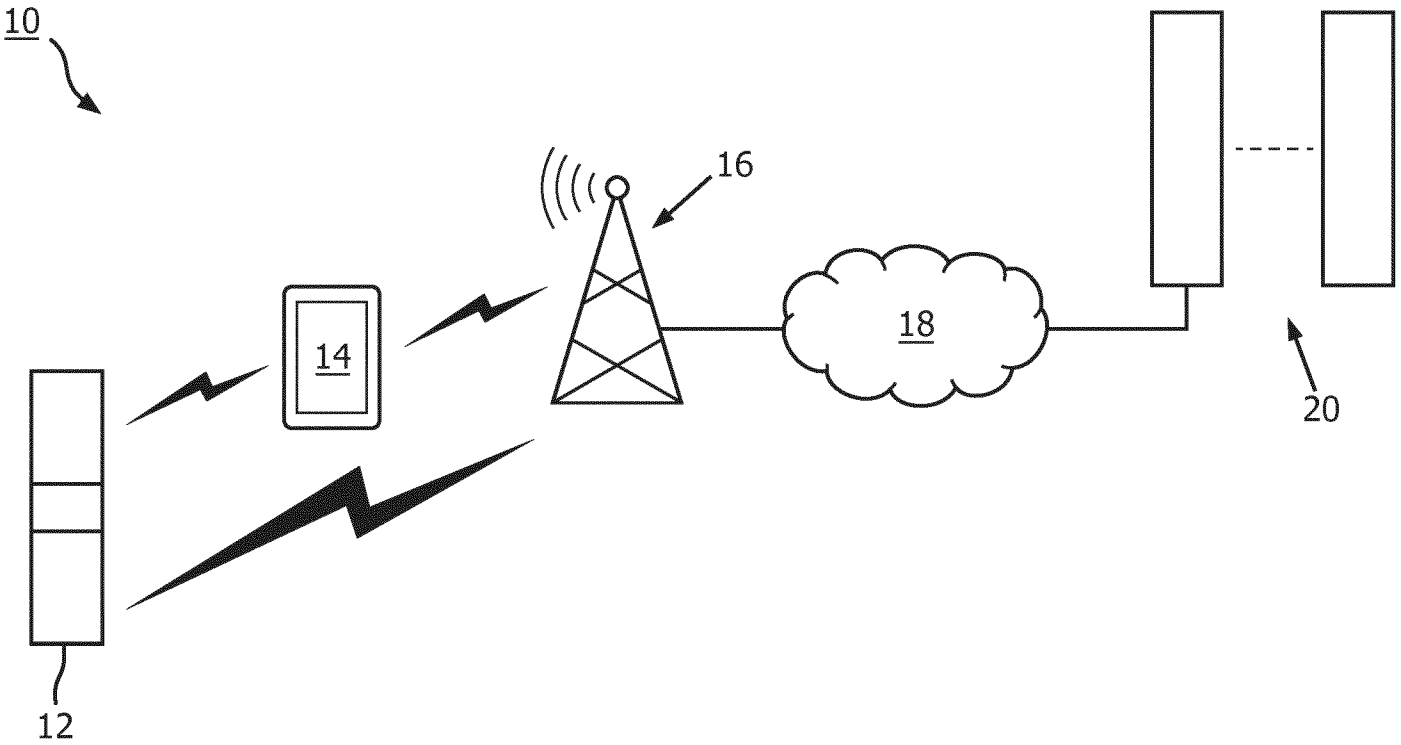
FIG. 1 is a schematic diagram that illustrates an example environment in which a fall detection system is used, in accordance with an embodiment of the invention.

Disclosed herein are certain embodiments of a fall detection system that improve fall detection and height change estimation when a sensing device is located at the wrist. The fall detection system tracks one or more features to determine whether an event involving a subject is a suspected fall event. If the event is a suspected fall event, such a determination is a trigger to additional processing to validate the determination. In one embodiment, the additional processing includes a determination of height change as corrected by arm direction information, which may result in issuance of an alert to enable assistance for a fall victim. The fall detection system operates under a principle of estimating the height change of the wrist while compensating for the direction of the arm. In effect, certain embodiments of a fall detection system transform wrist height changes to body or torso height changes, bringing the broad spectrum of wrist movements back to that of torso-based sensing.

Digressing briefly, existing fall detection systems may use air pressure sensors and accelerometers to determine the height change of the wrist and wrist velocity to assist in reducing false alarms, yet neglect to consider the direction of the arm before and after the fall. In contrast, by correcting height changes from a suspected fall using arm direction before and after the event, normal arm movement is less likely to cause false alarms, and wrist sensing is effectively converted to the more accurate body sensing.

Having summarized certain features of a fall detection system of the present disclosure, reference will now be made in detail to the description of a fall detection system as illustrated in the drawings. While a fall detection system will be described in connection with these drawings, there is no intent to limit the fall detection system to the embodiment or embodiments disclosed herein. For instance, though described primarily in the context of a wrist worn device, in some embodiments, functionality of the fall detection system may be distributed among plural devices or attached in locations proximal to the wrist (e.g., as jewelry located on a finger, or embedded or otherwise attached at or near the hand). Further, although the description identifies or describes specifics of one or more embodiments, such specifics are not necessarily part of every embodiment, nor are all various stated advantages necessarily associated with a single embodiment or all embodiments. On the contrary, the intent is to cover all alternatives, modifications and equivalents consistent with the disclosure as defined by the appended claims. Further, it should be appreciated in the context of the present disclosure that the claims are not necessarily limited to the particular embodiments set out in the description.

Note that reference herein to an event involving a subject refers to sensed movement of the subject, whereas a suspected fall event arises from a trigger that results in additional processing to validate that the sensed movement of the subject is actually a fall event (i.e., the subject has fallen).

Figure 2:
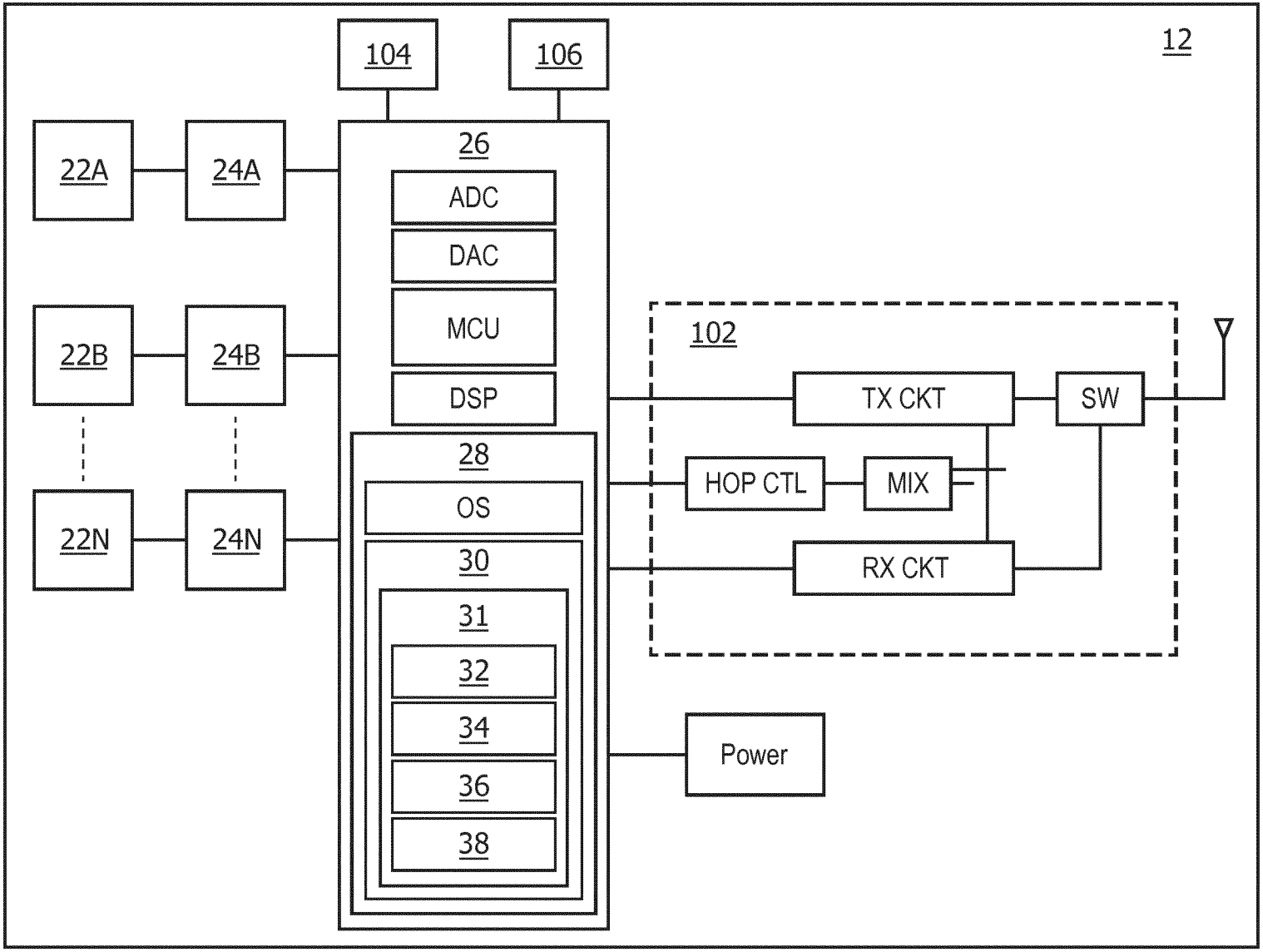
FIG. 2 is a schematic diagram that illustrates an example wearable device in which all or a portion of the functionality of a fall detection system may be implemented, in accordance with an embodiment of the invention.

Referring now to FIG. 1, shown is an example environment 10 in which certain embodiments of a fall detection system may be implemented. It should be appreciated by one having ordinary skill in the art in the context of the present disclosure that the environment 10 is one example among many, and that some embodiments of a fall detection system may be used in environments with fewer, greater, and/or different components that those depicted in FIG. 1. The environment 10 comprises a plurality of devices that enable communication of information throughout one or more networks. The depicted environment 10 comprises a wearable device 12, an electronics device 14, a cellular/wireless network 16, a wide area network 18 (e.g., also described herein as the Internet), and a remote computing system 20 comprising one or more computing devices and/or storage devices, all coupled via a wired and/or wireless connection. The wearable device 12, as described further in association with FIG. 2, is typically worn by the user (e.g., around the wrist in the form of a watch, strap, or band-like accessory, or around the torso or attached to an article of clothing), and comprises a plurality of sensors. In one embodiment, the wearable device 12 comprises an air pressure sensor to track pressure (and hence height, as described below) of the wrist and an accelerometer to track arm movement and arm direction. In some embodiments, an air pressure sensor may be omitted, and height change determinations may be achieved using signals from the accelerometer, including estimation of the vertical direction and performing double integration on the accelerometer measurements. In some embodiments, the height change determinations may be achieved using the accelerometer alone, or in some embodiments, in conjunction with a gyroscope and/or magnetometer. Combining the estimate with the measurement from an air pressure sensor (hence, present) is yet another option. In some embodiments, the wearable device 12 may comprise sensors that perform other functions, including tracking physical activity of the user (e.g., steps, swim strokes, pedaling strokes, sports activities, etc.), sense/measure or derive physiological parameters (e.g., heart rate, respiration, skin temperature, etc.) based on the sensor data, and optionally sense various other parameters (e.g., outdoor temperature, humidity, location, etc.) pertaining to the surrounding environment of the wearable device 12. For instance, in some embodiments, the wearable device 12 may comprise a global navigation satellite system (GNSS) receiver (and associated positioning software and antenna(s)), including a GPS receiver, which tracks and provides location coordinates (e.g., latitude, longitude, altitude) for the device 12. Other information associated with the recording of coordinates may include speed, accuracy, and a time stamp for each recorded location. In some embodiments, the location information may be in descriptive form, and geofencing (e.g., performed locally or external to the wearable device 12) is used to transform the descriptive information into coordinate numbers. In some embodiments, the wearable device 12 may comprise indoor location or proximity sensing technology, including beacons, RFID or other coded light technologies, Wi-Fi, etc. In some embodiments, GNSS functionality may be performed at the electronics device 14 in addition to, or in lieu of, such functionality being performed at the wearable device 12. Some embodiments of the wearable device 12 may include a gyroscope. In some embodiments, in addition to their use in fall detection, the accelerometer and optionally gyroscope may be used to for detection of limb movement and type of limb movement to facilitate the determination of whether the user is engaged in sports activities, stair walking, or bicycling, or the provision of other contextual data. A representation of such gathered data may be communicated to the user via an integrated display on the wearable device 12 and/or on another device or devices. In some embodiments, the wearable device 12 may be embodied as a virtual reality device or an augmented reality device. In some embodiments, the wearable device 12 may be embodied as an implantable, which may include biocompatible sensors that reside underneath the skin or are implanted elsewhere. In some embodiments, the wearable device 12 may possess less than some of the functionality described above, providing a wrist worn sensing device dedicated solely or substantially to fall detection.

Also, such data gathered by the wearable device 12 may be communicated (e.g., continually, periodically, and/or aperiodically, including upon request or upon detection of a suspected fall event) via a communications unit to one or more electronics devices, such as the electronics device 14 and/or to the computing system 20. Such communications may be achieved wirelessly (e.g., using near field communications (NFC) functionality, Blue-tooth functionality, 802.11-based technology, telephony, etc.) and/or according to a wired medium (e.g., universal serial bus (USB), etc.). Further discussion of the wearable device 12 is described below in association with FIG. 2.

The electronics device 14 may be embodied as a smartphone, mobile phone, cellular phone, pager, stand-alone image capture device (e.g., camera), laptop, tablet, workstation, smart glass (e.g., Google Glass™), virtual reality device, augmented reality device, among other handheld and portable computing/communication devices. In some embodiments, the electronics device 14 is not necessarily readily portable or even portable. For instance, the electronics device 14 may be a home appliance, including an access point, router, a refrigerator, microwave, oven, pillbox, home monitor, stand-alone home virtual assistant device, one or more of which may be coupled to the computing system 20 via one or more networks (e.g., through the home Internet connection or telephony network), or a vehicle appliance (e.g., the automobile navigation system or communication system). In the depicted embodiment of FIG. 1, the electronics device 14 is a smartphone, though it should be appreciated that the electronics device 14 may take the form of other types of devices including those described above. Further discussion of the electronics device 14 is described below in association with FIG. 3, with smartphone and electronics device 14 used interchangeably hereinafter. In other words, for the sake of simplicity, the electronics device 14 is referred to herein also as a smartphone, though not limited to smartphones.

In one embodiment, the wearable device 12 comprises all of the functionality of the fall detection system. In some embodiments, the wearable device 12 and other devices may collectively comprise the functionality of the fall detection system, such devices including the electronics device 14 and/or a device(s) of the computing system 20. For instance, the wearable device 12 may monitor (track) one or more features (e.g., air pressure changes, acceleration impacts, etc.) to determine whether to trigger for additional processing. For example, in one embodiment, the wearable device 12 measures a norm of an acceleration signal, in another an average of the acceleration signal over a window of time, and in yet another it observes an air pressure change, relative to a threshold, to determine if a possible event has happened involving the subject (user) to have fallen. If so, the wearable device 12 performs additional processing to validate whether the suspected fall event is indeed an actual fall, which processing includes the determination of height change (e.g., using pressure change, or other information from which height information may be obtained) and arm direction to compute the height change as corrected by the arm direction, and communicate an alert to one or more devices (e.g., to an emergency call center, family phone, host platform, including the computing system 20, handling emergency calls and alerting emergency personnel, etc.) to request assistance for the fall victim. In one embodiment, the alert provided by the wearable device 12 to one or more devices may trigger activation of hardware of one or more devices, including triggering dialing functionality of a telephonic device (e.g., to place a call to emergency personnel and/or other parties that may assist the user in the case of a fall), alarm circuitry (e.g., at an emergency response facility, family members' home or devices, etc. that prompts action to assist the user), or audio recording (e.g., via transmission of a pre-recorded audio, or in some embodiments, audio/visual message seeking help). For instance, alarm circuitry may provide for audible, visual, and/or tactile feedback corresponding to the fall detection. As another example, one or more family members may receive the alert (signal) from the wearable device 12 via an electronics device 14, the alert causing audio and/or visual circuitry of the electronics device to be activated, indicating to the family member the fall event. In some embodiments, family members may have a dedicated device at home or the office that comprises audio and/or visual circuitry that may receive the alert from the wearable device 12 and responsively cause the device to audibly and/or visually alert the family member. These and/or other examples to alert others to assist the user after the fall may be used, and hence are contemplated to be within the scope of the disclosure. The communication of the alert may be achieved directly by suitable communication functionality in the wearable device 12 or indirectly via communication to an intermediary device, including the electronics device 14, which in turn may communicate over a wired or wireless medium the alert to another device. As another example, the wearable device 12 may sense the air pressure (or information used to determine height information) and arm direction, and communicate the pressure or information used to determine height information and arm direction (e.g., once a trigger has been met or, assuming sufficient transmission bandwidth, continuously streaming all information) to the electronics device 14 and/or to the computing system 20 for computation of height change as corrected by arm direction at the electronics device 14, which in turn sends an alert. These and/or other variations amongst the components of the environment 10 may be used to perform the functionality of certain embodiments of a fall detection system.

The cellular/wireless network 16 may include the necessary infrastructure to enable cellular communications by the electronics device 14 and optionally the wearable device 12. There are a number of different digital cellular technologies suitable for use in the cellular/wireless network 16, including, for the cellular embodiment: GSM, GPRS, CDMAOne, CDMA2000, Evolution-Data Optimized (EV-DO), EDGE, Universal Mobile Telecommunications System (UMTS), Digital Enhanced Cordless Telecommunications (DECT), Digital AMPS (IS-136/TDMA), and Integrated Digital Enhanced Network (iDEN), among others. For the wireless embodiment, the cellular/wireless network 16 may use wireless fidelity (WiFi) to receive data converted by the wearable device 12 and/or the electronics device 14 to a radio format and format for communication over the Internet 18. The cellular/wireless network 16 may comprise a modem, router, etc.

The wide area network 18 may comprise one or a plurality of networks that in whole or in part comprise the Internet. The electronics device 14 and optionally wearable device 12 may access one or more devices of the computing system 20 via the Internet 18, which may be further enabled through access to one or more networks including PSTN (Public Switched Telephone Networks), POTS, Integrated Services Digital Network (ISDN), Ethernet, Fiber, DSL/ADSL, WiFi, Zigbee, BT, BTLE, among others.

The computing system 20 comprises one or more devices coupled to the wide area network 18, including one or more computing devices networked together, including an application server(s) and data storage. The computing system 20 may serve as a cloud computing environment (or other server network) for the electronics device 14 and/or wearable device 12, performing processing and data storage on behalf of (or in some embodiments, in addition to) the electronics devices 14 and/or wearable device 12. When embodied as a cloud service or services, the device(s) of the remote computing system 20 may comprise an internal cloud, an external cloud, a private cloud, or a public cloud (e.g., commercial cloud). For instance, a private cloud may be implemented using a variety of cloud systems including, for example, *Eucalyptus* Systems, VMWare vSphere®, or Microsoft® HyperV. A public cloud may include, for example, Amazon EC2®, Amazon Web Services®, Terremark®, Savvis®, or GoGrid®. Cloud-computing resources provided by these clouds may include, for example, storage resources (e.g., Storage Area Network (SAN), Network File System (NFS), and Amazon S3®), network resources (e.g., firewall, load-balancer, and proxy server), internal private resources, external private resources, secure public resources, infrastructure-as-a-services (IaaSs), platform-as-a-services (PaaSs), or software-as-a-services (SaaSs). The cloud architecture of the devices of the remote computing system 20 may be embodied according to one of a plurality of different configurations. For instance, if configured according to MICROSOFT AZURE™, roles are provided, which are discrete scalable components built with managed code. Worker roles are for generalized development, and may perform background processing for a web role. Web roles provide a web server and listen for and respond to web requests via an HTTP (hypertext transfer protocol) or HTTPS (HTTP secure) endpoint. VM roles are instantiated according to tenant defined configurations (e.g., resources, guest operating system). Operating system and VM updates are managed by the cloud. A web role and a worker role run in a VM role, which is a virtual machine under the control of the tenant. Storage and SQL services are available to be used by the roles. As with other clouds, the hardware and software environment or platform, including scaling, load balancing, etc., are handled by the cloud.

In some embodiments, the devices of the remote computing system 20 may be configured into multiple, logically-grouped servers (run on server devices), referred to as a server farm. The devices of the remote computing system 20 may be geographically dispersed, administered as a single entity, or distributed among a plurality of server farms, executing one or more applications on behalf of or in conjunction with one or more of the electronic devices 14 and/or wearable device 12. The devices of the remote computing system 20 within each farm may be heterogeneous. One or more of the devices may operate according to one type of operating system platform (e.g., WINDOWS NT, manufactured by Microsoft Corp. of Redmond, Wash.), while one or more of the other devices may operate according to another type of operating system platform (e.g., Unix or Linux). The group of devices of the remote computing system 20 may be logically grouped as a farm that may be interconnected using a wide-area network (WAN) connection or medium-area network (MAN) connection. The devices of the remote computing system 20 may each be referred to as (and operate according to) a file server device, application server device, web server device, proxy server device, or gateway server device.

In one embodiment, the computing system 20 may receive information (e.g., raw data and identifying information from the wearable device 12 or as routed via the electronics device 14) for computation of the corrected height change and provision of an alert to one or more devices (e.g., family members, emergency services, etc.). In some embodiments, the computing system 20 may receive the corrected height change (e.g., from the wearable device 12 or electronics device 14) and use that information to send an alert. The computing system 20 may be a part of a call center, where operators receive the alert and communicate with the fall victim (e.g., the subject wearing the wearable device 12) to determine whether assistance is needed. In some embodiments, the wearable device 12 and/or electronics device 14 may communicate an alert (e.g., formatted as a text message or voice message or email) to other devices of individuals or entities that are designated (e.g., by the subject) as recipients of the alert (i.e., that will assist the subject in the case of a fall or other emergency). Such alerts may be received and routed by the computing system 20 to those individual devices, or in some embodiments, the computing system 20 may not be involved in the fall detection process (and the alerts delivered directly from the wearable device 12 and/or the electronics device 14). The functions of the computing system 20 described above are for illustrative purpose only. The present disclosure is not intended to be limiting. The computing system 20 may include one or more general computing server devices or dedicated computing server devices. The computing system 20 may be configured to provide backend support for a program developed by a specific manufacturer. However, the computing system 20 may also be configured to be interoperable across other server devices and generate information in a format that is compatible with other programs. In some embodiments, one or more of the functionality of the computing system 20 may be performed at the respective devices 12 and/or 14. Further discussion of the computing system 20 is described below in association with FIG. 4.

As one illustrative example of operations of an embodiment of a fall detection system where the wearable device 12 is responsible for height change correction functionality, the wearable device 12 performs the sensing and processing functions, communicating an alert directly or via the electronics device 14 to the computing system 20 (or in some embodiments, indirectly or directly to devices of family, emergency personnel, and/or emergency contacts).

As one illustrative example of operations of an embodiment of a fall detection system where the electronics device 14 is responsible for height change correction functionality, the wearable device 12 regularly sends the electronics device 14 pressure or height information and arm direction information that the electronics device 14 uses to compute height change as corrected for arm direction. In some embodiments, the pressure or height information and arm direction information is sent based on one or more features indicating that an event involving the subject is a suspected fall event (i.e., rising to the level of requiring further processing as initially determined at the wearable device 12). When the corrected height change indicates a strong likelihood that a suspected fall event is an actual fall event (e.g., the corrected height change meeting or exceeding a threshold level), an alert is sent by the electronics device 14 to the computing system 20 (and/or other devices in some embodiments), which in turn requests assistance from emergency personnel and/or family or other emergency contacts.

Attention is now directed to FIG. 2, which illustrates an example wearable device 12 in which all or a portion of the functionality of a fall detection system may be implemented. That is, FIG. 2 illustrates an example architecture (e.g., hardware and software) for the example wearable device 12. It should be appreciated by one having ordinary skill in the art in the context of the present disclosure that the architecture of the wearable device 12 depicted in FIG. 2 is but one example, and that in some embodiments, additional, fewer, and/or different components may be used to achieve similar and/or additional functionality. In one embodiment, the wearable device 12 comprises a plurality of sensors 22 (e.g., 22A-22N), including an air pressure (AP) sensor 22A, accelerometer (ACC) sensor 22B (e.g., for measuring acceleration along three (3) orthogonal axes), among other optional sensors through 22N, one or more signal conditioning circuits 24 (e.g., SIG COND CKT 24A-SIG COND CKT 24N) coupled respectively to the sensors 22, and a processing circuit 26 (PROCESS CKT, also referred to as a processor) that receives the conditioned signals from the signal conditioning circuits 24. The sensors 22 are collectively referred to herein also as a sensory system, which may include any one or combination of the sensors 22. In some embodiments, the air pressure sensor 22A may not be present. In one embodiment, the processing circuit 26 comprises an analog-to-digital converter (ADC), a digital-to-analog converter (DAC), a microcontroller unit (MCU), a digital signal processor (DSP), and memory (MEM) 28. In some embodiments, the processing circuit 26 may comprise fewer or additional components than those depicted in FIG. 2. For instance, in one embodiment, the processing circuit 26 may consist entirely of the microcontroller. In some embodiments, the processing circuit 26 may include the signal conditioning circuits 24.

The memory 28 comprises an operating system (OS) and application software (ASW) 30, which in one embodiment comprises a fall detection program. In some embodiments, additional software may be included for enabling physical and/or behavioral tracking, among other functions. In the depicted embodiment, the application software 30 comprises a classifier (CLASS) 31 comprising a pressure sensor measurement module (PSMM) 32 for processing signals received from the air pressure sensor 22A, an accelerometer measurement module (AMM) 34 for processing signals received from the accelerometer sensor 22B, a height change computation module (HCCM) 36, and a communications module (CM) 38. In some embodiments, additional modules used to achieve the disclosed functionality of a fall detection system, among other functionality, may be included, or one or more of the modules 31-38 may be separate from the application software 30 or packaged in a different arrangement than shown relative to each other. In some embodiments, fewer than all of the modules 31-38 may be used in the wearable device 12, such as in embodiments where the wearable device 12 merely provides sensor measurement functionality for communication of raw sensor data to one or more other devices.

The pressure sensor measurement module 32 comprises executable code (instructions) to process the signals (and associated data) measured by the air pressure sensor 22A. For instance, the pressure sensor measurement module 32 regularly receives the pressure measurement from the output of the air pressure sensor 22A. In one embodiment, the pressure sensor measurement module 32 may instruct the air pressure sensor 22A to sample at specified sampling instances. For instance, the pressure sensor measurement module 32 may instruct the air pressure sensor 22A to sample at a fixed sampling distance (d) or during intervals or durations of sampling instances. In one embodiment, the sampling distance between a current pressure reading and a prior pressure reading may be based on a delay of half (0.5) seconds, in which case, the sampling rate is FsP equals 2 Hz. FsP is the sampling rate of the air pressure sensor 22A.

The accelerometer measurement module 34 comprises executable code (instructions) to process the signals (and associated data) measured by the accelerometer sensor 22B. The accelerometer measurement module 34 regularly receives signals (e.g., arm direction information, velocity, etc.) from the accelerometer sensor 22B. For instance, sampling of the accelerometer sensor 22B may correspond in time to the sampling instances of the air pressure sensor 22A. Typically, the accelerometer operates at a sampling rate (FsA) of 50 Hz. Arm direction is given by the orientation of the sensor, which in turn can be estimated from the accelerometer by observing a group of samples of low variance. The low variance indicates there is little movement and the acceleration signal is mostly due to gravity. By taking the average or median, for example, an estimate is made of the gravity component in the sensor's coordinate system, which in other words indicates the orientation of the sensor. In some embodiments, next to estimating arm direction from the sensed gravity in the accelerometer, the estimation can be improved by including or by using other sensing modalities, including magnetometers and/or gyroscopes. With these additional sensing modalities, either included or used instead, the orientation of the sensor is estimated. The sensor orientation may be expressed as the orientation of the sensor coordinate system relative to the global (or Earth) coordinate system. The sensor coordinate system may be chosen freely, but is fixed after that. The global coordinate system is also free to be chosen, but typically the z-axis is chosen to be vertical upwards, and x and y axes correspond to North-South and East-West directions.

The height change computation module 36 comprises executable code (instructions) to determine a preliminary or reference height change based on the received pressure measurements, and a height change (final height change) comprising the preliminary height change corrected for arm direction before and after a fall event.

The classifier 31 uses these modules 32-38 to track one or more features to determine if an event involving the subject is a suspected fall event and to validate the determination. That is, the classifier 31 uses the signals from the sensors 22 to determine whether an event involving a subject comprises a suspected fall event, triggering additional processing to validate that the event is a fall event. The classifier 31 discriminates between a range of values or value combinations for one or more features. Stated otherwise, one or more features of a certain value or values may be used for this validation processing, including height change, orientation change, impact, and/or velocity. Each of these values may be compared to respective thresholds to confirm that the event is a suspected fall event, or taken in various combinations for the determination of whether the event is a suspected fall event. In one embodiment, the classifier 31 uses classifier methodology from known artificial intelligence (e.g., machine learning), where each value or combination of values is assigned a binary outcome (e.g., fall event, non-fall event). In other words, the classifier 31 may use machine learning techniques, where the classifier 31 is trained with example sets of known falls and non-falls. The classifier 31 continuously or regularly receives signals from the sensors 22 to assess the presence of a trigger. In one embodiment, the trigger to additional processing is an accelerometer signal (e.g., comprising an accelerometer measurement) having a large peak value (e.g., due to an impact of the subject against an object or floor). The peak value defines the trigger, and arm direction is extracted before the trigger and after the trigger as part of the additional processing. For instance, the arm direction is extracted by averaging and normalizing acceleration over a one (1) second window along a so-called arm-direction axis (explained below), where the window at both sides of the trigger is located such that a total variance in the acceleration over that window is below a threshold value (implying little movement, so acceleration is due to gravity and the measurement informs about direction). If the variance does not drop below the set threshold within, for instance, three (3) seconds from the trigger, the last second of the window, or the window with the lowest variance, is used. Another example of a trigger may be an air pressure signal, where the current air pressure is continuously or regularly monitored and compared to a period of time before the trigger (e.g., two (2) seconds before). If the difference exceeds a threshold (e.g., the pressure rises when the subject is falling), a trigger is defined at that threshold surpassing instant. Alternatively, before the trigger is defined, the classifier 31 may sample air pressure regularly and, for each sample, compute the change in pressure (dP), the latter of which may be used as a trigger. Once the trigger is defined, the classifier 31 may repeat the search for a maximum dP (which is at the trigger instant or after that, given the threshold test that raised the trigger). In some embodiments, combinations of the various features may be used for determining a trigger. For instance, a high impact value (e.g., a value that surpasses a threshold) may give rise to a trigger (e.g., using a norm of the acceleration measurement). Once the trigger is determined, the classifier 31 defines a window around the trigger in a manner similar to the description above, such as one (1) second before the trigger and up to two (2) seconds afterwards. Note that the aforementioned processing that uses prior data (e.g., a defined period of time prior to the current time) and/or a window of data is made possible by storing or buffering the sensor data in memory 28 and then accessing the data from memory 28 based on the trigger. The length of time and/or amount of data that may be stored in memory 28 before being written over or otherwise made unavailable is based on the programmed (or in some embodiments, user configured) design constraints of the intended applications and resources and capabilities of the wearable device 12. The classifier 31 searches the largest change in pressure (dP).

Continuing the description of the classifier 31, a value for impact may be determined in one of several ways. One method of relatively low complexity is to determine the largest value of the norm of the acceleration measurement over a window of interest. Another method includes averaging the values over a short window (e.g., 0.1-1 seconds) to compute this average over a sequence of windows (e.g., shifting the window by one sample and re-computing for every next-shifted window), and determining the largest value over this range of windows. The range of windows may be expanded over a predetermined interval around the trigger. Yet another method includes computing the variance in the acceleration measurements and searching for the location of the maximum, using schemes similar to the aforementioned methods.

With regard to orientation change, the classifier 31 can determine orientation change by estimating the orientation of the sensor (e.g., accelerometer 22B) before and after the fall (e.g., based on finding a window of low variance). Orientation may be expressed as the direction of gravity in the sensor's coordinate system. Gravity points along the vertical direction, and by that, its direction in the sensor coordinate system represents the direction of the sensor 22B. Strictly, this orientation excludes a possible rotation along the vertical (e.g., facing north or west), which is of little to no relevance in fall detection. The direction of gravity may be estimated from the (average) acceleration. For instance, when there is little motion (e.g., as indicated by low variance in the acceleration signal), the measured acceleration is due to gravity, and by normalizing the measured (and averaged) acceleration to a vector of unit length, an estimate of the direction of the vertical is obtained. The orientation change is determined by computing the inner product between the orientation before and after the triggering event (where the inner product of two vectors of unity length is known to equal the cosine of their included angle).

Arm direction is different from orientation. Whereas orientation observes the direction of gravity (the vertical) in the full sensor-coordinate system, arm direction observes the projection of gravity along the axis in the arm direction. For example, assume the direction of gravity is found to be (gx, gy, gz) in the sensor coordinate system, and assume that the arm is aligned with the vector (ax, ay, az) in the sensor coordinate system (e.g., described below in conjunction with arrows at the wrist in FIGS. 5 and 6A). Then, the arm direction follows in one embodiment as the inner product of these two vectors ($gx \cdot ax + gy \cdot ay + gz \cdot az$). Accordingly, the change in arm direction is also different from orientation change. As indicated above, in some embodiments, estimation of arm direction via an accelerometer signal may be augmented by other sensing modalities (e.g., magnetometers and/or gyroscopes). Arm direction may be determined from sensor orientation. For instance, the arm direction is found from the sensor orientation as described above. Explaining further, assume that the arm direction is aligned with the vector (ax, ay, az) in the sensor coordinate system (e.g., described below in conjunction with arrows at the wrist in FIGS. 5 and 6A). Given the estimated orientation of the sensor, the direction of the vertical (i.e., the direction of gravity) is determined by transforming the vector (0,0,1) in the global coordinate system (i.e., the global's z-axis pointing upwards) to its representation (gx, gy, gz) in the sensor coordinate system. This transformation follows from the estimated sensor orientation, and may be implemented by using (rotation) matrix or quaternion representation and corresponding calculus, for example. Given the vectors (ax, ay, az) and (gx, gy, gz), the arm direction as needed for the height correction follows, in one embodiment, as the inner product of these two vectors (gx·ax+gy·ay+gz·az). When both vectors are normalized to unit length, the inner product equals cos(α) in FIG. 6B. In one embodiment, the sensor coordinate system is chosen to be aligned with the physical arm direction, for example, the sensor's x-axis points across the watch or band (e.g., along the arm from shoulder to hand). Then, ax=1 and ay=az=0. The computation of the inner product simplifies to determining the value of the gx component alone. Estimation of orientation using gyroscopes with accelerometers and/or magnetometers is generally referred to sensor fusion, and often by using Kalman or particle filter techniques.

Velocity measurements may also be used by the classifier 31 to validate whether the event is a suspected fall event. Certain techniques for determining velocity may be found in commonly assigned, U.S. publications 20140156216, incorporated by reference in its entirety, and 20150317890, incorporated by reference in its entirety, wherein at least one of the techniques is described below.

Referring back to height change correction, the processing involving height change correction may be implemented via the height change correction module 36 as part of the additional processing of the classifier 31, culminating in the issuance of an alert. Beginning with the description for the preliminary height change, given a suspected fall event, and given the sensed environmental pressure P, the height change dH can be computed by the height change computation module 36 from the pressure change dP through a linear relation:

$$dH=-k1/PdP, \quad \text{(Eqn. 1)}$$

where k is a constant (except for temperature). In particular, k=(RT/Mg), where R is the universal gas constant (8.3 Nm/molK), T is environmental temperature in Kelvin, M is molecular mass (0.029 kg/mol for air), and g is the gravitational constant (9.81 m/sec$^2$). At room temperature, k is approximately 8400 m. The value for dP (and/or dH) may be computed by the height computation module 36 as an initial trigger, or to further validate a determination (based on a different trigger) that an event involving the subject is a suspected fall event, and the value obtained for dP (or dH) are used for subsequent corrected height change computations. Also as indicated above, P can be measured by regularly sampling the air pressure sensor's output, possibly averaged over a set of measurements. The pressure change, dP, can be measured according to at least two approaches. In a first approach, the difference is computed (e.g., by the height change computation module 36 executing on the processing circuit 26) between the current pressure reading and prior pressure reading that occurs a fixed time earlier: dP[k]=P[k]−P[k−d], where k is the sampling instant and d the (fixed) sampling distance. For example if a delay of 2 seconds is used, d=round(2*FsP), where FsP is the sampling rate of the air pressure sensor 22A. Given the sequence dP[k], its maximum (e.g., maximum, since a height drop translates to a pressure rise) is searched around a window of the event. In other words, it is assumed a trigger has been raised (e.g., due to an impact value that exceeds a threshold, such as via the use of the norm of an accelerometer signal) and there is a suspected fall event. Given the trigger, a window is defined around it (e.g., 1 second before the trigger and up to 2 seconds after it), and over that window, a search is performed of the largest dP value. Note that the dP value may have served as a trigger as described previously, where the search for a maximum dP is repeated. This maximum is used in Eqn. 1. In a second approach, it is assumed the event is identified by a central point reflecting the potential impact of the suspected fall event. In other words, based on a trigger being raised (e.g., some tracked feature has surpassed a threshold), at some point, the observed signal that resulted in the trigger returns below the threshold. Within that window, a maximum may be searched (e.g., maximum accelerometer signal). The maximum may be considered as the central point (which defines the time of the event). More specifically, a region before (B) the impact and a region after (A) the impact is selected. The pressure difference, dP, follows as the difference between P[A] and P[B]. Preferably, P[A] and P[B] are determined using some averaging over the regions A and B. Averaging can be achieved by computing the mathematical average, but can also be achieved by estimators, including median operators. In one embodiment, the size of each of the regions A and B is 2-5 sec.

Referring now to the processing of the height change computation module 36 corresponding to the corrected height change functionality, a brief description of the approach follows. In one embodiment, a correction is made to the determined height change dH. The correction is based on the direction of the arm before and after the (suspected) fall event. Arm direction is estimated from the orientation of the sensor (e.g., accelerometer sensor 22B), which assumes (or in some embodiments derives or is informed via user input) the way the sensor is attached to the wrist is known. For example, the accelerometer's x-axis points along the direction of the arm, from hand to shoulder (though an opposite positive x-axis may be used in some embodiments). When the arm is hanging down, gravity will fully appear along this x-axis, yielding +9.8 m/sec$^2$ as the reading (the sensor's x-axis points upwards). When resting on a chair's elbow rest, or lying on a table, gravity is nearly absent in the x-direction. Reference to the axis pointing along the arm, from hand to shoulder, is referred to also herein as the aAxis.

Given a suspected fall event, a preliminary or reference height change refers to a height change when the arm would have been horizontal during the whole event (e.g., using a reference location from the torso, such as the shoulder). A corrected height change refers to the fact that there is an increase in the difference between the corrected and reference height change when the arm is down before the fall or if the arm is up after the fall, and there is a decrease in the difference between the corrected and reference height change when the arm is up before the fall and down after the fall. Stated in absolute terms, the height is lowered when the arm is up and increased when the arm is down, in this way estimating torso (e.g., shoulder) height rather than wrist height.

Figure 5:
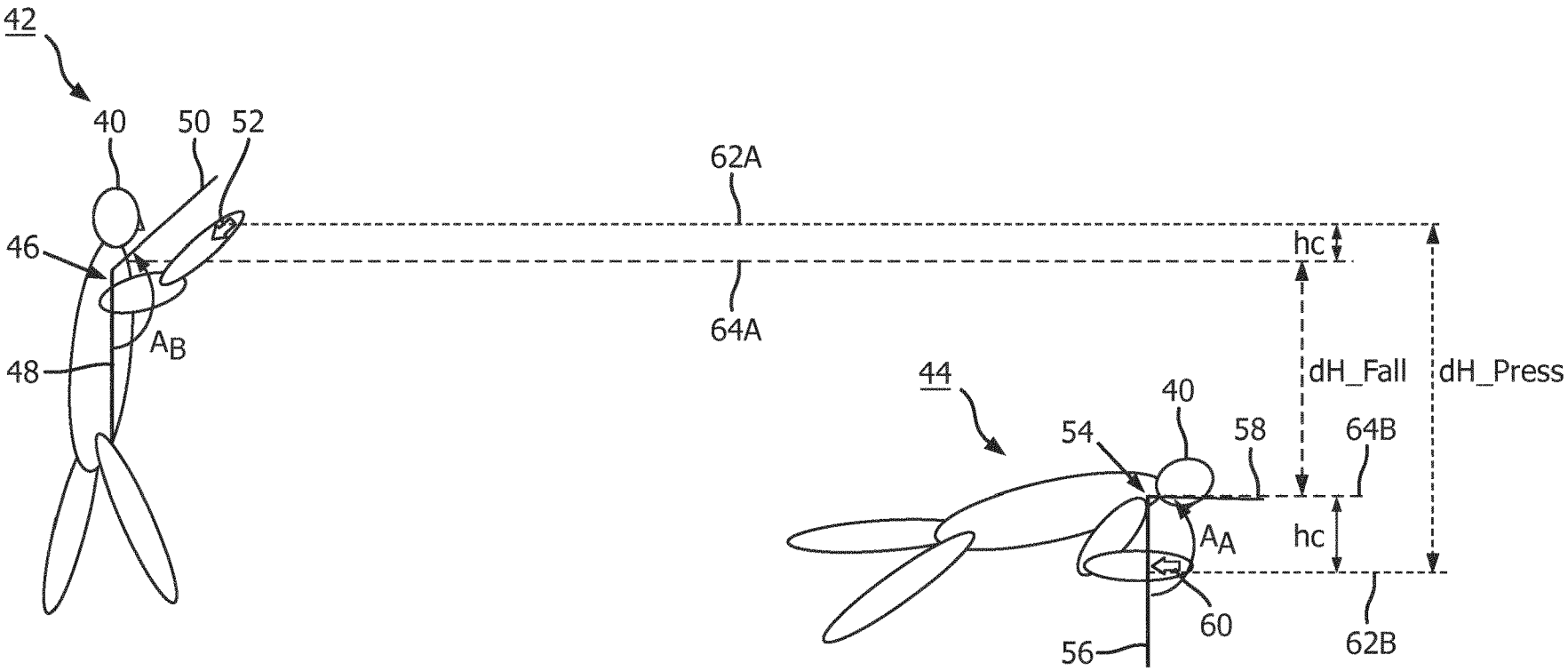
FIG. 5 is a schematic diagram that illustrates an example fall event and parameters of relevance to a fall detection system, in accordance with an embodiment of the invention.
Figures 6A, 6B:
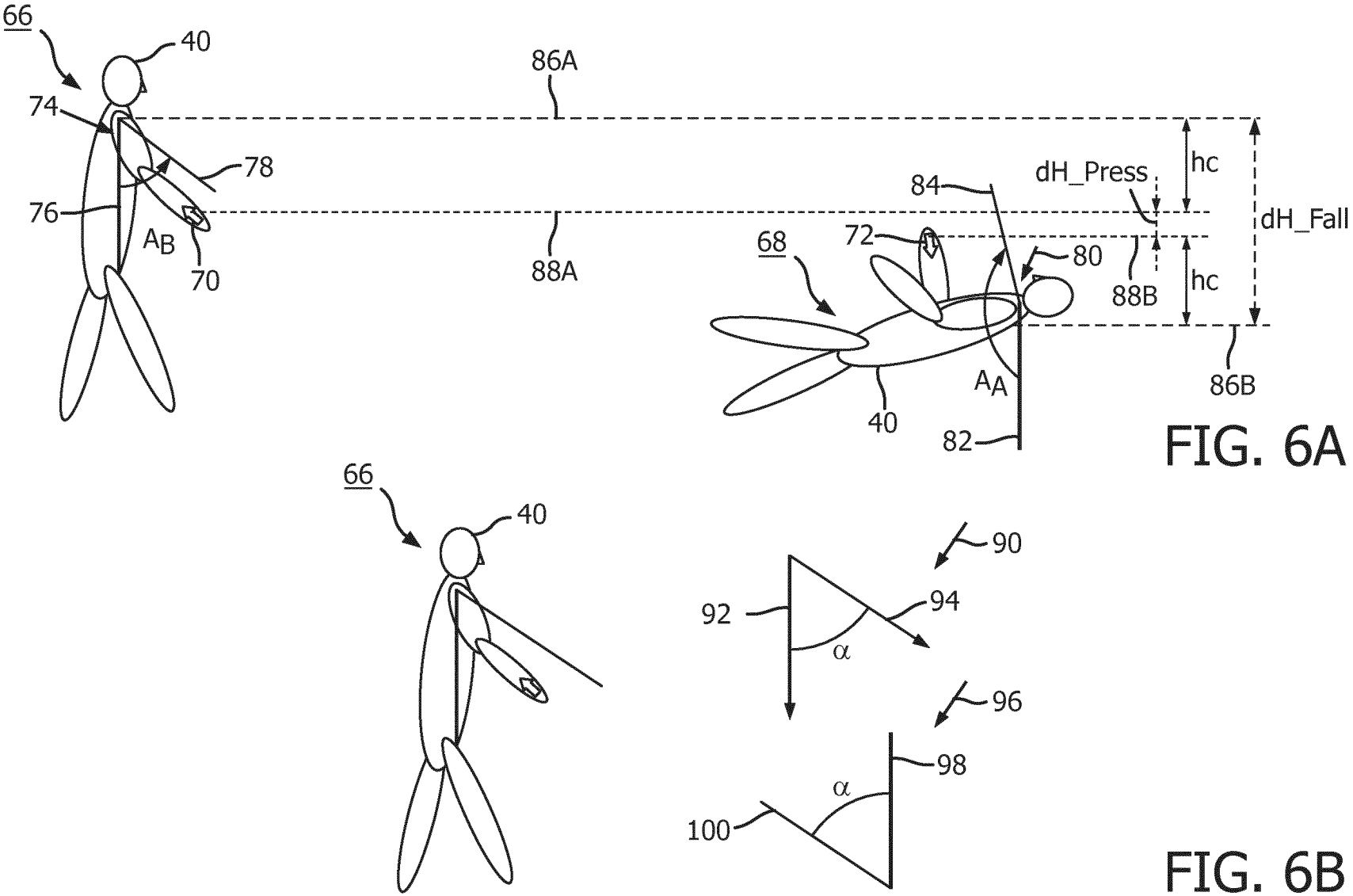
FIGS. 6A-6B are schematic diagrams that illustrate another example fall event and parameters of relevance to a fall detection system, in accordance with an embodiment of the invention.

Having generally described an approach by the height change computation module 36 to corrected height determinations, attention is directed to FIGS. 5-6B, which help to conceptually illustrate the computations performed for the corrected height change determination. In FIG. 5, a subject 40 is schematically shown in two different postures including a posture before (posture 42) and after (posture 44) a fall (a fall event). Before the fall, a direction axes 46 is shown overlaid on the subject 40 for the posture 42, the direction axes 46 comprising one axis 48 equal to the vertical and another axis 50 substantially aligned with the raised arm of the subject. The accelerometer sensors values are expressed in a sensor coordinate system having an x-axis, a y-axis, and a z-axis, where acceleration is observed in one embodiment along the x-axis (assuming the sensor's x-axis is aligned with the arm as described above). Note that if the sensor axes are not aligned with the arm, the sensor reading may be projected on a virtual axis along the arm direction. The axis 50 forms an angle, $A_B$ (angle before the fall event), with the vertical axis 48, the intersection of the two axes 48 and 50 shown at a reference point on the torso of the subject 40 (in this example, depicted at approximately the shoulder). The angle A is used to express the orientation of the arm. Note that this orientation is one example representation for use in computing arm direction. Another form could be the angle of axis 50 to the horizontal plane. The choice of representation affects the further computations, as is known from geometry (e.g., where using a cosine function in the first representation a sine might be needed in the second). A vector 52 is also shown overlaid on the wrist of the subject 40 for posture 42, the vector 52 representing a sensor (e.g., accelerometer sensor 22B, FIG. 2) and a positive direction of the axis 50 along the arm direction (e.g., pointing from the wrist to the shoulder, though the positive direction may be reversed with an appropriate change in signage of equations described below). For the subject 40 oriented in the posture 44 after the fall (fall event), it is evident that the subject 40 is substantially prone (face-down in this example), propped up on his or her elbows. A direction axes 54 is again shown overlaid on the subject 40, with a vertical axis 56 and a second axis 58 again depicted as intersecting at a reference point (e.g., shoulder), the axis 58 is again aligned with the arm of the subject 40 (being (close to) horizontal, in this case). The angle formed between the axis 56 and axis 58 is shown as $A_A$ (the angle after the fall event), which in the depicted example is at about ninety (90) degrees. A vector 60 is shown positioned over the wrist of the subject 40, again pointing from the wrist toward the arm. The dashed lines in FIG. 5 represent various parameters used in the computation of corrected height change. In particular, dashed lines 62A and 62B are referenced from the wrist sensor positions of the subject 40 in postures 42 and 44, and equate to the height drop, dH_press, observed by the sensor. Dashed lines 64A and 64B are referenced from the shoulder (reference point on the torso), and equate to the actual height drop, dH_Fall. The difference between the top dashed lines 62A and 64A equates to a correction value, hc, due to the arm direction before the fall, and likewise, the difference between lower dashed lines 62B and 64B equate to a correction value, hc, due to the arm direction after the fall. In other words, equations executed by the height change computation module 36 bring dH_pressure, via corrections hc, into a corrected height change, dH_corr, the latter closer to dH_Fall, reducing the range of variance that all possible arm directions may impose. A lower variance improves the detection accuracy. For example, while sitting next to a table and when lifting the arm and letting it hit the table, the sensor signals may be similar to those from an actual fall. However, after the described corrections, a dH_Fall of about zero will result, reducing the likelihood the signals stem from an actual fall. Vice versa, it may happen that a user falls while grabbing a bar. As a consequence, while the user's body goes down and impacts the floor, the wrist stays at more or less the same height. However, the orientation of the arm before the fall, before going down, is directed downwards, a small angle A, and after the fall, when on the floor, it is directed upwards, at an angle close to or approaching 180 degrees. The two directions result in corrections h_c that turn the vanishing dH_press into a number close to dH_Fall.

As one example illustration of how these computations are implemented by the height change computation module 36, attention is directed to FIGS. 6A and 6B. In this example, the subject 40 exhibits two different postures. To the left in the figure, the subject 40 is shown in an upright posture 66 with the arms angled downward, whereas to the right in the figure, the subject 40 is shown in a posture 68 where he or she is lying on his or her back, arms folded over the chest (despite the figure perhaps suggesting a more upright extension of the arms). The subject 40 in posture 66 has a vector 70 shown overlaid at the wrist, which denotes the wrist sensor, and which denotes the positive direction along the arm direction (from wrist to shoulder). The subject 40 in posture 68 likewise has a vector 72 at the wrist, again denoting the wrist sensor, and which denotes the positive direction along the arm from the wrist. The subject 40 in posture 66 shows an overlaid direction axes 74, with vertical axis 76 and axis 78 corresponding to the arm direction, an angle formed between axes 76 and 78 equal to $A_B$ (angle before the fall event). The intersection of axes 76 and 78 is depicted as being located at a reference point on the torso (e.g., at the shoulder). Note that, mathematically, tracking or monitoring of the arm direction is implemented, and then assuming an arm length, an estimate of how much the arm adds to the height is made (which at that point, the relation of the arm to the shoulder is evident since the arm hinges at that point). Note that since one goal is the determination of the height change of the subject, any other body reference point may be used (e.g., adding an offset to the shoulder, which offset cancels upon computation of the difference). The subject 40 in posture 68 is shown with an overlaid direction axes 80, with vertical axis 82 and axis 84 corresponding to the arm direction, an angle formed between axes 82 and 84 equal to $A_A$ (angle after the fall event). The intersection of axes 82 and 84 is depicted as being located at a reference point on the torso (e.g., at the shoulder). Dashed lines 86A and 86B are referenced from the shoulder (reference point on the torso), and equate to the actual height drop, dH_Fall. Dashed lines 88A and 88B are referenced from the wrist sensor positions of the subject 40 in postures 66 and 68, and equate to the height drop, dH_press, observed by the sensor. The difference between the top dashed lines 86A and 88A equates to a correction value, hc, due to the arm direction before the fall, and likewise, the difference between lower dashed lines 86B and 88B equate to a correction value, hc, due to the arm direction after the fall. In other words, equations executed by the height change computation module 36 bring dH_press, via corrections hc, into a corrected height change, dH_corr, the latter closer to dH_Fall, reducing the range of variance.

Referring now to FIG. 6B, shown is the subject 40 in posture 66 reproduced from FIG. 6A, and the axes 76 and 78 of direction axes 74 with angle $A_B$ recast as direction axes 90, with height correction (hc) axis 92 (directed along vertical 76 and sized to correction height hc) and arm axis 94 sized to arm length al, forming angle, $\alpha$. In other words, the size of axis 92 follows as al*cos($\alpha$). In one embodiment, the height correction (hc) is estimated by assuming an arm length, al. In general, the assumed arm length before a fall is larger than the assumed arm length after the fall (since arms are likely more stretched before a fall than after a fall). For example, some good estimates may be that arm length is 0.7 meters (m) before, and 0.4 m after, the suspected fall event. Experiments have shown the following:

if $-20<dH_press<0$ (cm), $al$=value within range 0.7-1.0 m (Eqn. 2)

if $-50<dH_press<-20$, $al$ equals proportional mapping of $dH$_press to value within range between 0.7-0.4 m, where $dH$_press is the height change as determined from the air pressure signal alone (also referred to herein as the reference height change or preliminary height change). (Eqn. 3)

From the direction axes 90, it can be observed that the height correction is as follows:

$$hc=al*\cos\alpha \quad \text{(Eqn. 4)}$$

cos α can be estimated from the measured direction of gravity, i.e. the observed acceleration when there is no further movement, or the average acceleration when there is little movement. aAxis is the direction of the arm in the sensor coordinate system. In the examples, aAxis coincides with the x-axis, i.e. aAxis=(1,0,0) in the sensor coordinate system. cos α is the cosine of the angle between arm direction and the vertical, i.e cos α equals the inner product of aAxis and the vertical (both vectors normalized to unit length). In the sensor coordinate system, the vertical appears as the direction of gravity, and the inner product with aAxis=(1,0,0) returns the x-coordinate of the measured gravity in the sensor coordinate system, where the measured gravity is normalized to unity. This leads to:

$$\cos\alpha=acc(x)/|acc| \quad \text{(Eqn. 5)}$$

where acc is the measured acceleration (in sensor coordinate system). In FIG. 6B, acc is 98, aAxis is in the direction of 100 (the arrow 70). The angle between 98 and 100 equals a, as can be seen from simple geometry in FIG. 6B, and cos α equals the gravity component in the aAxis direction, i.e. the x-coordinate in the example, where gravity is normalized to unity. Since commonly there is some movement, the accelerometer value is averaged over a suitable interval to estimate the gravity. Preferably the interval is identical to the region used to measure the air pressure. For good estimation of direction, a region of low activity is selected and where the x, y, and z components stay constant (no rotation).

The effective height change is computed as follows:

$$dH\text{corr}=\text{dHpress}+hc_{before}-hc_{after} \quad \text{(Eqn. 6)}$$

where from Eqns. 4-5, $hc_{before}$ equals $al_{before}*\cos\alpha_{before}$ (e.g., $\cos\alpha_{before}$ is acc(x)/|acc| taken along sensor axis along the arm from hand to shoulder before the suspected fall) and $hc_{after}$ equals $al_{after}*\cos\alpha_{after}$ (e.g., $\cos\alpha_{after}$ is acc(x)/|acc| taken along sensor axis along the arm from hand to shoulder after the suspected fall). Another way to express Eqn. 6 is by substitution of these aforementioned values to obtain:

$$dH\text{corr}=\text{dHpress}+al_{before}*\cos\alpha_{before}-al_{after}*\cos\alpha_{after} \quad \text{(Eqn. 7)}$$

Care should be taken with regard to the signs. For instance, before the fall, hc is added, such that pointing upwards (arm hanging, positive cos α) increases the dH_corr, and after the fall, hc is subtracted, such that pointing downwards (arm up, negative cos α) increases dH_corr.

Another way to view Eqn. 7 is to place in terms of assumed values for arm length before (0.7) and after (0.4) the suspected fall. In that case, Eqn. 7 becomes:

$$dH_\text{corr}=dH_\text{press}+0.7\cos\alpha_{before}-0.4\cos\alpha_{after} \quad \text{(Eqn. 8)}$$

In some embodiments, the joint probability of the height change (pressure change) with the orientation before and orientation after the (possible) fall event is computed. The orientation values can be simplified to the value along the aAxis, as in Eqn. 5. Another form of joint classification can be designed by taking the joint probability of the compensated and uncompensated height changes. Stated otherwise, instead of applying Eqn. 8 (or similar equations described above) and using dH_corr as a value in the classifier 31 (together with other values, like impact), the values dH_press, $\alpha_{before}$, and $\alpha_{after}$ are individually assessed by the classifier 31 (e.g., the arm direction is still used before and after the event to decide whether the event is a suspected fall event). Further, instead of deciding on the likelihood that the event is a suspected fall event based on the set of separate likelihoods for each value, the joint likelihood for the values (e.g., the three values dH_press, $\alpha_{before}$, and $\alpha_{after}$) may be taken together.

Referring back to FIG. 2 and the application software 30, the communications module 38 comprises executable code (instructions) to enable a communications circuit 102 of the wearable device 12 to operate according to one or more of a plurality of different communication technologies (e.g., NFC, Bluetooth, Zigbee, 802.11, Wireless-Fidelity, etc.). For purposes of illustration, the communications module 38 is described herein as providing for control of communications with the electronics device 14 and/or the computing system 20 (FIG. 1). In one embodiment, an alert is communicated to the electronics device 14 and/or the computing system 20 via the communications module 38. In some embodiments, the communications module 38 may receive messaging from the electronics device 14 and/or computing system 20, such as status of obtaining help (e.g., a call has been made to emergency personnel, or providing an opportunity to cancel an impending call, etc.). In an embodiment where the raw data is communicated to the electronics device 14 and/or the computing system 20 and one or more of equations 1-8 are computed by application software at the electronics device 14 and/or computing system 20, the communications module 38, in cooperation with the communications circuit 102, may provide for the transmission of raw sensor data and/or the derived information from the sensor data to the electronics device 14 for processing by the electronics device 14, or to the computing system 20 (directly via the cellular/wireless network 16 and/or Internet or via the electronics device 14) for processing at the computing system 20. In some embodiments, the communications module 38 may also include browser software in some embodiments to enable Internet connectivity, and may also be used to access certain services, such as mapping/place location services, which may be used to determine a context for the sensor data. These services may be used in some embodiments of a fall detection system, and in some instances, may not be used. In some embodiments, the location services may be performed by a client-server application running on the electronics device 14 and a device of the remote computing system 20.

As indicated above, in one embodiment, the processing circuit 26 is coupled to the communications circuit 102. The communications circuit 102 serves to enable wireless communications between the wearable device 12 and other devices, including the electronics device 14 and/or in some embodiments, device(s) of the computing system 20, among other devices. The communications circuit 102 is depicted as a Bluetooth (BT) circuit, though not limited to this transceiver configuration. For instance, in some embodiments, the communications circuit 102 may be embodied as any one or a combination of an NFC circuit, Wi-Fi circuit, transceiver circuitry based on Zigbee, BT low energy, 802.11, GSM, LTE, CDMA, WCDMA, among others such as optical or ultrasonic based technologies.

The processing circuit 26 is further coupled to input/output (I/O) devices or peripherals, including an input interface 104 (INPUT) and the output interface 106 (OUT). In some embodiments, an input interface 104 and/or output interface 106 may be omitted. Note that in some embodiments, functionality for one or more of the aforementioned circuits and/or software may be combined into fewer components/modules, or in some embodiments, further distributed among additional components/modules or devices. For instance, the processing circuit 26 may be packaged as an integrated circuit that includes the microcontroller (microcontroller unit or MCU), the DSP, and memory 28, whereas the ADC and DAC may be packaged as a separate integrated circuit coupled to the processing circuit 26. In some embodiments, one or more of the functionality for the above-listed components may be combined, such as functionality of the DSP performed by the microcontroller.

As indicated above, the sensors 22A and 22B comprise an air pressure sensor and a single or multi-axis accelerometer (e.g., using piezoelectric, piezoresistive or capacitive technology in a microelectromechanical system (MEMS) infrastructure), respectively. In some embodiments, additional sensors may be included (e.g., sensors 22N) to perform detection and measurement of a plurality of physiological and behavioral parameters. For instance, typical physiological parameters include heart rate, heart rate variability, heart rate recovery, blood flow rate, activity level, muscle activity in addition to arm direction, including core movement, body orientation/position, power, speed, acceleration, etc.), muscle tension, blood volume, blood pressure, blood oxygen saturation, respiratory rate, perspiration, skin temperature, electrodermal activity (skin conductance response), body weight, and body composition (e.g., body mass index or BMI), articulator movements (especially during speech). Typical behavioral parameters or activities including walking, running, cycling, and/or other activities, including shopping, walking a dog, working in the garden, sports activities, browsing internet, watching TV, typing, etc.). One of the sensors 22 may be embodied as an inertial sensor (e.g., gyroscopes) and/or magnetometers. In some embodiments, at least one of the sensors 22 may include GNSS sensors, including a GPS receiver to facilitate determinations of distance, speed, acceleration, location, altitude, etc. (e.g., location data, or generally, sensing movement). In some embodiments, GNSS sensors (e.g., GNSS receiver and antenna(s)) may be included in the electronics device 14 in addition to, or in lieu of, those residing in the wearable device 12. The sensors 22 may also include flex and/or force sensors (e.g., using variable resistance), electromyographic sensors, electrocardiographic sensors (e.g., EKG, ECG), magnetic sensors, photoplethysmographic (PPG) sensors, bio-impedance sensors, infrared proximity sensors, acoustic/ultrasonic/audio sensors, a strain gauge, galvanic skin/sweat sensors, pH sensors, temperature sensors, and photocells. The sensors 22 may include other and/or additional types of sensors for the detection of environmental parameters and/or conditions, for instance, barometric pressure, humidity, outdoor temperature, pollution, noise level, etc. One or more of these sensed environmental parameters/conditions may be influential in the determination of the state of the user. In some embodiments, the sensors 22 include proximity sensors (e.g., iBeacon® and/or other indoor/outdoor positioning functionality, including those based on Wi-Fi or dedicated sensors), that are used to determine proximity of the wearable device 12 to other devices that also are equipped with beacon or proximity sensing technology. In some embodiments, GNSS functionality and/or the beacon functionality may be achieved via the communications circuit 102 or other circuits coupled to the processing circuit 26.

The signal conditioning circuits 24 include amplifiers and filters, among other signal conditioning components, to condition the sensed signals including data corresponding to the sensed physiological parameters and/or location signals before further processing is implemented at the processing circuit 26. Though depicted in FIG. 2 as respectively associated with each sensor 22, in some embodiments, fewer signal conditioning circuits 24 may be used (e.g., shared for more than one sensor 22). In some embodiments, the signal conditioning circuits 24 (or functionality thereof) may be incorporated elsewhere, such as in the circuitry of the respective sensors 22 or in the processing circuit 26 (or in components residing therein). Further, although described above as involving unidirectional signal flow (e.g., from the sensor 22 to the signal conditioning circuit 24), in some embodiments, signal flow may be bi-directional. For instance, in the case of optical measurements, the microcontroller may cause an optical signal to be emitted from a light source (e.g., light emitting diode(s) or LED(s)) in or coupled to the circuitry of the sensor 22, with the sensor 22 (e.g., photocell) receiving the reflected/refracted signals.

The communications circuit 102 is managed and controlled by the processing circuit 26 (e.g., executing the communications module 38). The communications circuit 102 is used to wirelessly interface with the electronics device 14 (FIG. 3) and/or in some embodiments, one or more devices of the computing system 20. In one embodiment, the communications circuit 102 may be configured as a Bluetooth transceiver, though in some embodiments, other and/or additional technologies may be used, such as Wi-Fi, GSM, LTE, CDMA and its derivatives, Zigbee, NFC, among others. In the embodiment depicted in FIG. 2, the communications circuit 102 comprises a transmitter circuit (TX CKT), a switch (SW), an antenna, a receiver circuit (RX CKT), a mixing circuit (MIX), and a frequency hopping controller (HOP CTL). The transmitter circuit and the receiver circuit comprise components suitable for providing respective transmission and reception of an RF signal, including a modulator/demodulator, filters, and amplifiers. In some embodiments, demodulation/modulation and/or filtering may be performed in part or in whole by the DSP. The switch switches between receiving and transmitting modes. The mixing circuit may be embodied as a frequency synthesizer and frequency mixers, as controlled by the processing circuit 26. The frequency hopping controller controls the hopping frequency of a transmitted signal based on feedback from a modulator of the transmitter circuit. In some embodiments, functionality for the frequency hopping controller may be implemented by the microcontroller or DSP. Control for the communications circuit 102 may be implemented by the microcontroller, the DSP, or a combination of both. In some embodiments, the communications circuit 102 may have its own dedicated controller that is supervised and/or managed by the microcontroller.

In one example operation for the communications circuit 102, a signal (e.g., at 2.4 GHz) may be received at the antenna and directed by the switch to the receiver circuit. The receiver circuit, in cooperation with the mixing circuit, converts the received signal into an intermediate frequency (IF) signal under frequency hopping control attributed by the frequency hopping controller and then to baseband for further processing by the ADC. On the transmitting side, the baseband signal (e.g., from the DAC of the processing circuit 26) is converted to an IF signal and then RF by the transmitter circuit operating in cooperation with the mixing circuit, with the RF signal passed through the switch and emitted from the antenna under frequency hopping control provided by the frequency hopping controller. The modulator and demodulator of the transmitter and receiver circuits may perform frequency shift keying (FSK) type modulation/demodulation, though not limited to this type of modulation/demodulation, which enables the conversion between IF and baseband. In some embodiments, demodulation/modulation and/or filtering may be performed in part or in whole by the DSP. The memory 28 stores the communications module 38, which when executed by the microcontroller, controls the Bluetooth (and/or other protocols) transmission/reception.

Though the communications circuit 102 is depicted as an IF-type transceiver, in some embodiments, a direct conversion architecture may be implemented. As noted above, the communications circuit 102 may be embodied according to other and/or additional transceiver technologies.

The processing circuit 26 is depicted in FIG. 2 as including the ADC and DAC. For sensing functionality, the ADC converts the conditioned signal from the signal conditioning circuit 24 and digitizes the signal for further processing by the microcontroller and/or DSP. The ADC may also be used to convert analogs inputs that are received via the input interface 104 to a digital format for further processing by the microcontroller. The ADC may also be used in baseband processing of signals received via the communications circuit 102. The DAC converts digital information to analog information. Its role for sensing functionality may be to control the emission of signals, such as optical signals or acoustic signals, from the sensors 22. The DAC may further be used to cause the output of analog signals from the output interface 106. Also, the DAC may be used to convert the digital information and/or instructions from the microcontroller and/or DSP to analog signals that are fed to the transmitter circuit. In some embodiments, additional conversion circuits may be used.

The microcontroller and the DSP provide processing functionality for the wearable device 12. In some embodiments, functionality of both processors may be combined into a single processor, or further distributed among additional processors. The DSP provides for specialized digital signal processing, and enables an offloading of processing load from the microcontroller. The DSP may be embodied in specialized integrated circuit(s) or as field programmable gate arrays (FPGAs). In one embodiment, the DSP comprises a pipelined architecture, which comprises a central processing unit (CPU), plural circular buffers and separate program and data memories according to a Harvard architecture. The DSP further comprises dual busses, enabling concurrent instruction and data fetches. The DSP may also comprise an instruction cache and I/O controller, such as those found in Analog Devices SHARC® DSPs, though other manufacturers of DSPs may be used (e.g., Freescale multi-core MSC81xx family, Texas Instruments C6000 series, etc.). The DSP is generally utilized for math manipulations using registers and math components that may include a multiplier, arithmetic logic unit (ALU, which performs addition, subtraction, absolute value, logical operations, conversion between fixed and floating point units, etc.), and a barrel shifter. The ability of the DSP to implement fast multiply-accumulates (MACs) enables efficient execution of Fast Fourier Transforms (FFTs) and Finite Impulse Response (FIR) filtering. Some or all of the DSP functions may be performed by the microcontroller. The DSP generally serves an encoding and decoding function in the wearable device 12. For instance, encoding functionality may involve encoding commands or data corresponding to transfer of information to the electronics device 14 (or a device of the computing system 20 in some embodiments). Also, decoding functionality may involve decoding the information received from the sensors 22 (e.g., after processing by the ADC).

The microcontroller comprises a hardware device for executing software/firmware, particularly that stored in memory 28. The microcontroller can be any custom made or commercially available processor, a central processing unit (CPU), a semiconductor based microprocessor (in the form of a microchip or chip set), a macroprocessor, or generally any device for executing software instructions. Examples of suitable commercially available microprocessors include Intel's® Itanium® and Atom® microprocessors, to name a few non-limiting examples. The microcontroller provides for management and control of the wearable device 12, including determination of a fall event and communication of an alert (or in some embodiments, raw data) to the electronics device 14 (and/or a device of the computing system 20 in some embodiments).

The memory 28 can include any one or a combination of volatile memory elements (e.g., random access memory (RAM, such as DRAM, SRAM, SDRAM, etc.)) and non-volatile memory elements (e.g., ROM, Flash, solid state, EPROM, EEPROM, etc.). Moreover, the memory 28 may incorporate electronic, magnetic, and/or other types of storage media. The memory 28 may be used to store sensor data over a given time duration and/or based on a given storage quantity constraint for later processing.

The software in memory 28 may include one or more separate programs, each of which comprises an ordered listing of executable instructions for implementing logical functions. In the example of FIG. 2, the software in the memory 28 includes a suitable operating system and the application software 30, which in one embodiment, performs fall detection functionality and provision of an alert through the use of software modules 31-38 based on the output from the sensors 22. The raw data from the sensors 22 may provide the input to one or more of equations 1-8 to perform fall detection functionality. As indicated above, the raw data from the sensors 22 may be passed on to the electronics device 14 and/or computing system for execution of one or more of the equations 1-8.

The operating system essentially controls the execution of computer programs, such as the application software 30 and associated modules 31-38, and provides scheduling, input-output control, file and data management, memory management, and communication control and related services. The memory 28 may also include user data, including weight, height, age, gender, goals, body mass index (BMI) that are used by the microcontroller executing the executable code of the algorithms to accurately interpret the measured proximity data, physiological, psychological, and/or behavioral data. The user data may also include historical data relating past recorded data to prior contexts, including fall history, and/or contact information (e.g., phone numbers) in the case of a fall event. In some embodiments, user data may be stored elsewhere (e.g., at the electronics device 14 and/or a device of the remote computing system 20).

The software in memory 28 comprises a source program, executable program (object code), script, or any other entity comprising a set of instructions to be performed. When a source program, then the program may be translated via a compiler, assembler, interpreter, or the like, so as to operate properly in connection with the operating system. Furthermore, the software can be written as (a) an object oriented programming language, which has classes of data and methods, or (b) a procedure programming language, which has routines, subroutines, and/or functions, for example but not limited to, C, C++, Python, Java, among others. The software may be embodied in a computer program product, which may be a non-transitory computer readable medium or other medium.

The input interface(s) 104 comprises one or more interfaces (e.g., including a user interface) for entry of user input, such as a button or microphone or sensor (e.g., to detect user input) or touch-type display screen. In some embodiments, the input interface 104 may serve as a communications port for downloaded information to the wearable device 12 (such as via a wired connection). The output interface(s) 106 comprises one or more interfaces for the presentation or transfer of data, including a user interface (e.g., display screen presenting a graphical user interface, virtual or augmented reality interface, etc.) or communications interface for the transfer (e.g., wired) of information stored in the memory, or to enable one or more feedback devices, such as lighting devices (e.g., LEDs), audio devices (e.g., tone generator and speaker), and/or tactile feedback devices (e.g., vibratory motor) and/or electrical feedback devices. For instance, in one embodiment, the application software 30, upon detecting a fall, may present feedback to the user that an alert is about to be sent, affording the user an opportunity to cancel the alert if it is a false alarm (or send an alert if a fall is undetected). In some embodiments, at least some of the functionality of the input and output interfaces 104 and 106, respectively, may be combined, including being embodied at least in part as a touch-type display screen for the entry of input and/or presentation of messages, among other data. In some embodiments, the input/output functionality of input and output interfaces 104 and 106 may be embodied as an emergency alert call button that the subject may press upon experiencing a fall event, where functionality of the fall detection system serves as backup for determination of a fall event and issuance of an alert in instances where the subject is unable to push the button (e.g., is incapacitated).

Figure 3:
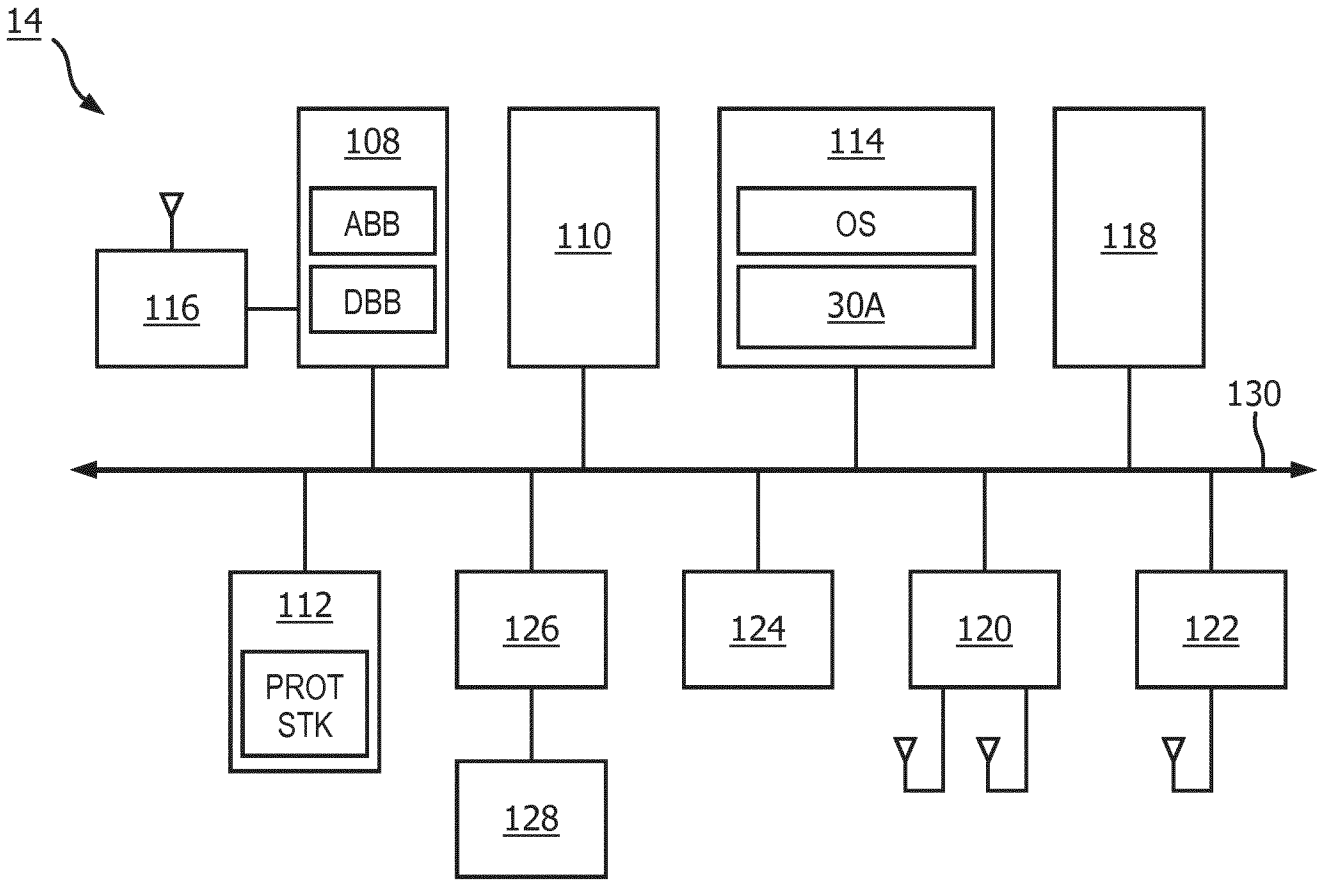
FIG. 3 is a schematic diagram that illustrates an example electronics device in which at least a portion of the functionality of a fall detection system may be implemented, in accordance with an embodiment of the invention.

Referring now to FIG. 3, shown is an example electronics device 14 in which at least a portion of the functionality of a fall detection system may be implemented. In the depicted example, the electronics device 14 is embodied as a smartphone (hereinafter, referred to as smartphone 14), though in some embodiments, other types of devices may be used, including a workstation, laptop, notebook, tablet, home or auto appliance, etc. It should be appreciated by one having ordinary skill in the art that the logical block diagram depicted in FIG. 3 and described below is one example, and that other designs may be used in some embodiments. As previously described, in some embodiments, the electronics device 14 may receive the alert from the wearable device 12 (FIG. 2), or receive the raw sensor data (e.g., pressure signals and accelerometer signals from the sensors 22A and 22B, respectively) and process the information (e.g., via computation of one or more of equations 1-8) to perform classifier functionality and/or to determine a height change as corrected by arm direction before and after a suspected fall event, and communicate an alert to one or more devices (e.g., the computing system 20 or other devices that may be used to alert emergency personnel, family, etc.). In some embodiments, processing of raw data to determine a corrected height change (and triggering an alert) may be achieved at the computing system 20, where the raw data is sent from the wearable device 12 to the computing system 20 directly or via the electronics device 14. Accordingly, the application software 30A may include all or at least a portion of the application software 30 (FIG. 2), and hence discussion of the same is omitted here for brevity. The smartphone 14 comprises at least two different processors, including a baseband processor (BBP) 108 and an application processor (APP) 110. As is known, the baseband processor 108 primarily handles baseband communication-related tasks and the application processor 110 generally handles inputs and outputs and all applications other than those directly related to baseband processing. The baseband processor 108 comprises a dedicated processor for deploying functionality associated with a protocol stack (PROT STK), such as a GSM (Global System for Mobile communications) protocol stack, among other functions. The application processor 110 comprises a multi-core processor for running applications, including all or a portion of the application software 30A. The baseband processor 108 and application processor 110 have respective associated memory (e.g., MEM) 112, 114, including random access memory (RAM), Flash memory, etc., and peripherals, and a running clock. Note that, though depicted as residing in memory 114, all or a portion of the modules of the application software 30A may be stored in memory 112, distributed among memory 112, 114, or reside in other memory.

More particularly, the baseband processor 108 may deploy functionality of the protocol stack to enable the smartphone 14 to access one or a plurality of wireless network technologies, including WCDMA (Wideband Code Division Multiple Access), CDMA (Code Division Multiple Access), EDGE (Enhanced Data Rates for GSM Evolution), GPRS (General Packet Radio Service), Zigbee (e.g., based on IEEE 802.15.4), Bluetooth, Wi-Fi (Wireless Fidelity, such as based on IEEE 802.11), and/or LTE (Long Term Evolution), among variations thereof and/or other telecommunication protocols, standards, and/or specifications. The baseband processor 108 manages radio communications and control functions, including signal modulation, radio frequency shifting, and encoding. The baseband processor 108 comprises, or may be coupled to, a radio (e.g., RF front end) 116 and/or a GSM modem, and analog and digital baseband circuitry (ABB, DBB, respectively in FIG. 3). The radio 116 comprises one or more antennas, a transceiver, and a power amplifier to enable the receiving and transmitting of signals of a plurality of different frequencies, enabling access to the cellular/wireless network 16 (FIG. 1). In one embodiment where functionality of the fall detection system is distributed among the wearable device 12, electronics device 14, and the computing system 20, the radio 116 enables the communication of raw sensor data and/or alerts and any other data (acquired via sensing functionality of the electronics device 14 and or relayed from inputs from a wearable device 12), and the receipt of messages (e.g., from the computing system 20). The analog baseband circuitry is coupled to the radio 116 and provides an interface between the analog and digital domains of the GSM modem. The analog baseband circuitry comprises circuitry including an analog-to-digital converter (ADC) and digital-to-analog converter (DAC), as well as control and power management/distribution components and an audio codec to process analog and/or digital signals received indirectly via the application processor 110 or directly from a smartphone user interface (UI) 118 (e.g., microphone, earpiece, ring tone, vibrator circuits, touchscreen, etc.). The ADC digitizes any analog signals for processing by the digital baseband circuitry. The digital baseband circuitry deploys the functionality of one or more levels of the GSM protocol stack (e.g., Layer 1, Layer 2, etc.), and comprises a microcontroller (e.g., microcontroller unit or MCU, also referred to herein as a processor) and a digital signal processor (DSP, also referred to herein as a processor) that communicate over a shared memory interface (the memory comprising data and control information and parameters that instruct the actions to be taken on the data processed by the application processor 110). The MCU may be embodied as a RISC (reduced instruction set computer) machine that runs a real-time operating system (RTIOS), with cores having a plurality of peripherals (e.g., circuitry packaged as integrated circuits) such as RTC (real-time clock), SPI (serial peripheral interface), I2C (inter-integrated circuit), UARTs (Universal Asynchronous Receiver/Transmitter), devices based on IrDA (Infrared Data Association), SD/MMC (Secure Digital/Multimedia Cards) card controller, keypad scan controller, and USB devices, GPRS crypto module, TDMA (Time Division Multiple Access), smart card reader interface (e.g., for the one or more SIM (Subscriber Identity Module) cards), timers, and among others. For receive-side functionality, the MCU instructs the DSP to receive, for instance, in-phase/quadrature (I/Q) samples from the analog baseband circuitry and perform detection, demodulation, and decoding with reporting back to the MCU. For transmit-side functionality, the MCU presents transmittable data and auxiliary information to the DSP, which encodes the data and provides to the analog baseband circuitry (e.g., converted to analog signals by the DAC).

The application processor 110 operates under control of an operating system (OS) that enables the implementation of a plurality of user applications, including the application software 30A. The application processor 110 may be embodied as a System on a Chip (SOC), and supports a plurality of multimedia related features including web browsing functionality to access one or more computing devices of the computing system 20 (FIG. 4) that are coupled to the Internet. For instance, the application processor 110 may execute communications functionality of the application software 30A (e.g., middleware, such as a browser with or operable in association with one or more application program interfaces (APIs)) to enable access to a cloud computing framework or other networks to provide remote data access/storage/processing, and through cooperation with an embedded operating system, access to calendars, location services, reminders, etc. For instance, in some embodiments, the fall detection system may operate using cloud computing, where the processing of raw data received (indirectly via the smartphone 14 or directly from the wearable device 12) may be achieved by one or more devices of the computing system 20, or, in some embodiments, the alerts may be communicated to the computing system 20 via the electronics device 14 and/or wearable device 12 (and corrected height change determined at the wearable device 12 or the electronics device 14). The application processor 110 generally comprises a processor core (Advanced RISC Machine or ARM), and further comprises or may be coupled to multimedia modules (for decoding/encoding pictures, video, and/or audio), a graphics processing unit (GPU), communications interface (COMM) 120, and device interfaces. In one embodiment, the communications interfaces 120 may include wireless interfaces, including a Bluetooth (BT) (and/or Zigbee in some embodiments) module that enable wireless communication with an electronics device, including the wearable device 12, other electronics devices, and a Wi-Fi module for interfacing with a local 802.11 network, according to corresponding communications software in the applications software 30A. The application processor 110 further comprises, or in the depicted embodiment, is coupled to, a global navigation satellite systems (GNSS) transceiver or receiver (GNSS) 122 for enabling access to a satellite network to, for instance, provide coordinate location services. In some embodiments, the GNSS receiver 122, in association with GNSS functionality in the application software 30A, collects contextual data (time and location data, including location coordinates and altitude), and provides a time stamp to the information provided internally or to a device or devices of the computing system 20 in some embodiments. Note that, though described as a GNSS receiver 122, other indoor/outdoor positioning systems may be used, including those based on triangulation of cellular network signals and/or Wi-Fi.

The device interfaces coupled to the application processor 110 may include the user interface 118, including a display screen. The display screen, in some embodiments similar to a display screen of the wearable device user interface, may be embodied in one of several available technologies, including LCD or Liquid Crystal Display (or variants thereof, such as Thin Film Transistor (TFT) LCD, In Plane Switching (IPS) LCD)), light-emitting diode (LED)-based technology, such as organic LED (OLED), Active-Matrix OLED (AMOLED), retina or haptic-based technology, or virtual/augmented reality technology. For instance, the user interface 118 may present web pages, personalized electronic messages, and/or other documents or data received from the computing system 20 and/or the display screen may be used to present information (e.g., personalized electronic messages) in graphical user interfaces (GUIs) rendered locally. Other user interfaces 118 may include a keypad, microphone, speaker, ear piece connector, I/O interfaces (e.g., USB (Universal Serial Bus)), SD/MMC card, among other peripherals. Also coupled to the application processor 110 is an image capture device (IMAGE CAPTURE) 124. The image capture device 124 comprises an optical sensor (e.g., a charged coupled device (CCD) or a complementary metal-oxide semiconductor (CMOS) optical sensor). The image capture device 124 may be used to detect various physiological parameters of a user, including blood pressure based on remote photoplethysmography (PPG). Also included is a power management device 126 that controls and manages operations of a battery 128. The components described above and/or depicted in FIG. 3 share data over one or more busses, and in the depicted example, via data bus 130. It should be appreciated by one having ordinary skill in the art, in the context of the present disclosure, that variations to the above may be deployed in some embodiments to achieve similar functionality.

In the depicted embodiment, the application processor 110 runs the application software 30A, which in one embodiment, includes all or a portion of the software modules (e.g., executable code/instructions) described in association with the application software 30 (FIG. 2) of the wearable device 12. For instance, in some embodiments, the application software 30A may consist of functionality of the classifier 31 or the height change computation module 36 (FIG. 2) and the communications module 38 when the electronics device 14 is used to perform height change correction based on raw data communicated by the wearable device 12 (FIG. 2) and to communicate an alert to the computing system 20 (FIG. 1) and/or receive messaging from the computing system 20. In some embodiments, the application software 30A consists of the communications module 38, where for instance, the wearable device 12 provides the raw data and the computing system 20 performs the classifier functionality or the height correction computations, wherein the electronics device 14 serves as an intermediate device for communication of the raw data. Or, in embodiments where the wearable device 12 performs the classification functionality, including the height correction computations, the electronics device 14 with the application software 30A consisting of the communications functionality, relays an alert from the wearable device 12 to one or more devices of the computing system 20 (or other devices).

Figure 4:
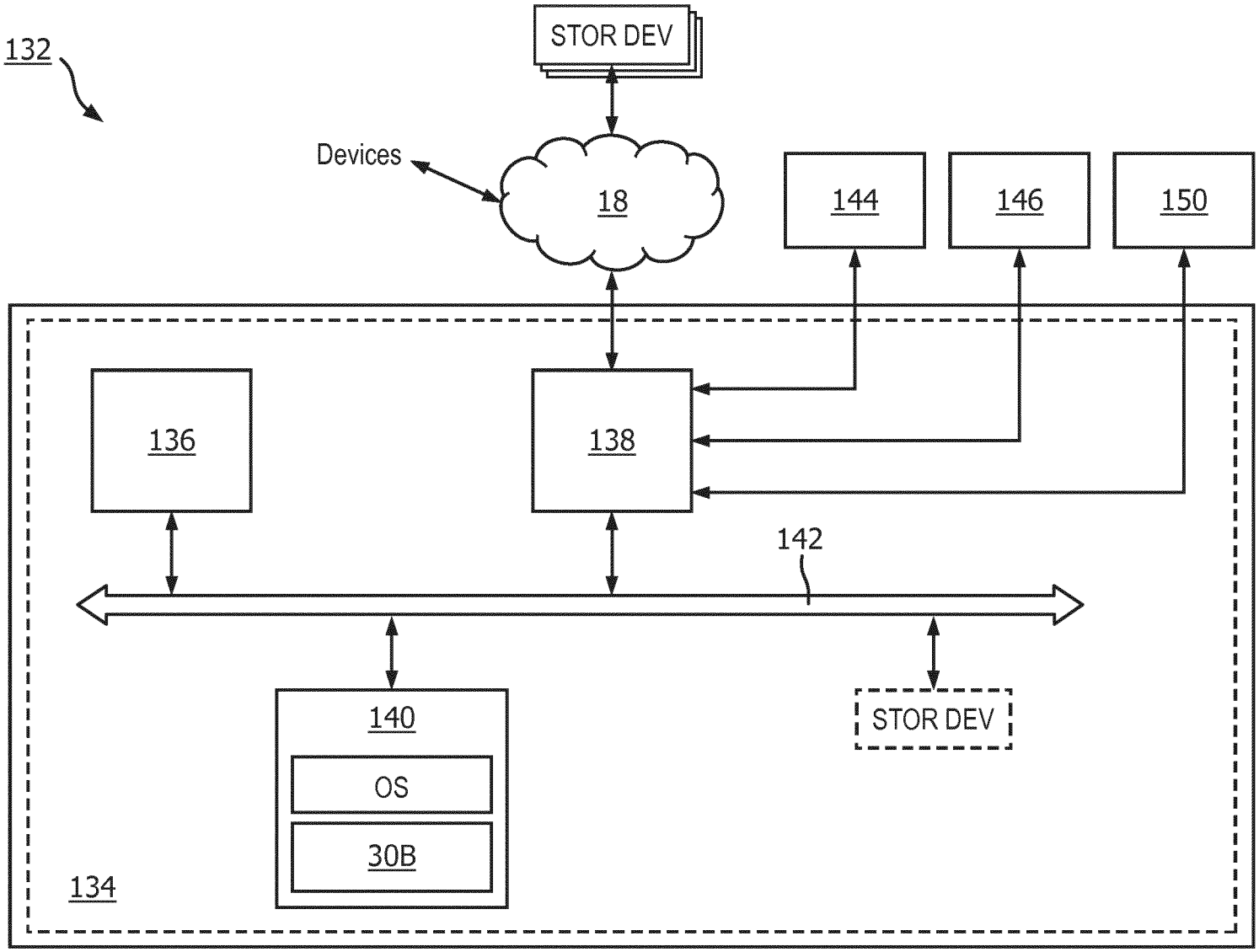
FIG. 4 is a schematic diagram that illustrates an example computing device in which at least a portion of the functionality of a fall detection system may be implemented, in accordance with an embodiment of the invention.

Referring now to FIG. 4, shown is a computing device 132 that may comprise a device or devices of the remote computing system 20 (FIG. 1) and which may comprise at least a portion of the functionality of a fall detection system. Functionality of the computing device 132 may be implemented within a single computing device as shown here, or in some embodiments, may be implemented among plural devices (i.e., that collectively perform the functionality described below). In one embodiment, the computing device 132 may be embodied as an application server device, a computer, among other computing devices. One having ordinary skill in the art should appreciate in the context of the present disclosure that the example computing device 132 is merely illustrative of one embodiment, and that some embodiments of computing devices may comprise fewer or additional components, and/or some of the functionality associated with the various components depicted in FIG. 4 may be combined, or further distributed among additional modules or computing devices in some embodiments. The computing device 132 is depicted in this example as a computer system, including a computer system providing functionality of an application server. It should be appreciated that certain well-known components of computer systems are omitted here to avoid obfuscating relevant features of the computing device 132. In one embodiment, the computing device 132 comprises a processing circuit 134 comprising hardware and software components. In some embodiments, the processing circuit 134 may comprise additional components or fewer components. For instance, memory may be separate from the processing circuit 134. The processing circuit 134 comprises one or more processors, such as processor (PROCESS) 136, input/output (I/O) interface(s) 138 (I/O), and memory 140 (MEM), all coupled to one or more data busses, such as data bus 142 (DBUS). The memory 140 may include any one or a combination of volatile memory elements (e.g., random-access memory RAM, such as DRAM, and SRAM, etc.) and nonvolatile memory elements (e.g., ROM, Flash, solid state, EPROM, EEPROM, hard drive, tape, CDROM, etc.). The memory 140 may store a native operating system (OS), one or more native applications, emulation systems, or emulated applications for any of a variety of operating systems and/or emulated hardware platforms, emulated operating systems, etc. In some embodiments, the processing circuit 134 may include, or be coupled to, one or more separate storage devices.

For instance, in the depicted embodiment, the processing circuit 134 is coupled via the I/O interfaces 138 to a user interface (UI) 144, user profile data structures (UPDS) 146, and a communications interface (COMM) 150. In some embodiments, the user interface 144, user profile data structures 146, and communications interface 150 may be coupled to the processing circuit 134 directly via the data bus 142 or coupled to the processing circuit 134 via the I/O interfaces 138 and the network 18 (e.g., network connected devices). In some embodiments, the user profile data structures 146 may be stored in a single device or distributed among plural devices. The user profile data structures 146 may be stored in persistent memory (e.g., optical, magnetic, and/or semiconductor memory and associated drives). In some embodiments, the user profile data structures 146 may be stored in memory 140.

The user profile data structures 146 are configured to store user profile data, indexed for instance by an identifier (e.g., device identifier) communicated from the wearable device 12 and/or electronics device 14. In one embodiment, the user profile data comprises demographics and user data, including emergency contact information (e.g., physician phone number, family member phone number, etc.) that personnel may use to respond to the alert, historical data (e.g., fall history, medical conditions, meds, etc.). The user profile data structures 146 may be accessed by the processor 136 executing software in memory 140.

In the embodiment depicted in FIG. 4, the memory 140 comprises an operating system (OS) and application software (ASW) 30B. Note that in some embodiments, the application software 30B may be implemented without the operating system. In one embodiment, the application software 30B comprises functionality of the one or more functions of the classifier 31, including the height change computation module 36 (FIG. 2), wherein the wearable device 12 communicates the raw sensor data to the computing device 132 (e.g., directly or indirectly via the electronics device 14) and the application software 30B determines the corrected height change and triggers a call alert via communications interface 150 to the appropriate emergency contacts. In some embodiments, the computing device 132 merely receives an alert from the wearable device 12 (or electronics device 14), where, for instance, the functionality of the application software 30B consists of communications functionality for contacting the appropriate emergency contact person (e.g., via communications interface 150) or via an administrator monitoring (via the user interface 144) the alert and responding to the subject and/or making a call to the appropriate emergency contact(s). The communications functionality of the applications software 30B generally enables communications among network-connected devices and provides web and/or cloud services, among other software such as via one or more APIs.

Execution of the application software 30B may be implemented by the processor 136 under the management and/or control of the operating system (or in some embodiments, without the use of the OS). The processor 136 may be embodied as a custom-made or commercially available processor, a central processing unit (CPU) or an auxiliary processor among several processors, a semiconductor based microprocessor (in the form of a microchip), a macroprocessor, one or more application specific integrated circuits (ASICs), a plurality of suitably configured digital logic gates, and/or other well-known electrical configurations comprising discrete elements both individually and in various combinations to coordinate the overall operation of the computing device 132.

The I/O interfaces 138 comprise hardware and/or software to provide one or more interfaces to the Internet 18, as well as to other devices such as a user interface (UI) 144 (e.g., keyboard, mouse, microphone, display screen, etc.) and/or the data structure 146. The user interfaces may include a keyboard, mouse, microphone, immersive head set, display screen, etc., which enable input and/or output by an administrator or other user. The I/O interfaces 138 may comprise any number of interfaces for the input and output of signals (e.g., analog or digital data) for conveyance of information (e.g., data) over various networks and according to various protocols and/or standards. The user interface (UI) 144 is configured to provide, among others, an interface between an administrator or operator and the computing device 132. As another example, the UI 144 can also be used to configure the fall detection software to personal aspects and choices. For example, to indicate whether the watch is (usually or at this moment) being worn at the left or right wrist, which the algorithm could use to set the positive arm-direction. (Alternatively, this could also be determined automatically by additional software). Another aspect could be to set the arm length to be used in the algorithms. Instead of arm length the user may enter body height, which is used to estimate arm length for that user. Yet another aspect can be to include or to disable a revocation period, or to set its duration. The revocation period would enable an automatic cancellation of a detected fall, e.g. because the device detects the user has stood-up again and/or is walking, etc. In some embodiments, the aforementioned functionality enabled through the UI 144 may be implemented via user interfaces at the wearable device 12 and/or the electronics device 14.

When certain embodiments of the computing device 132 are implemented at least in part with software (including firmware), as depicted in FIG. 4, it should be noted that the software can be stored on a variety of non-transitory computer-readable medium for use by, or in connection with, a variety of computer-related systems or methods. In the context of this document, a computer-readable medium may comprise an electronic, magnetic, optical, or other physical device or apparatus that may contain or store a computer program (e.g., executable code or instructions) for use by or in connection with a computer-related system or method. The software may be embedded in a variety of computer-readable mediums for use by, or in connection with, an instruction execution system, apparatus, or device, such as a computer-based system, processor-containing system, or other system that can fetch the instructions from the instruction execution system, apparatus, or device and execute the instructions.

When certain embodiments of the computing device 132 are implemented at least in part with hardware, such functionality may be implemented with any or a combination of the following technologies, which are all well-known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), relays, contactors, etc.

It is noted that for electronics device 14 comprising a laptop, workstation, notebook, etc., a similar architecture may be used as shown in, and described in association with, the computing device 132 of FIG. 4.

Figure 7:
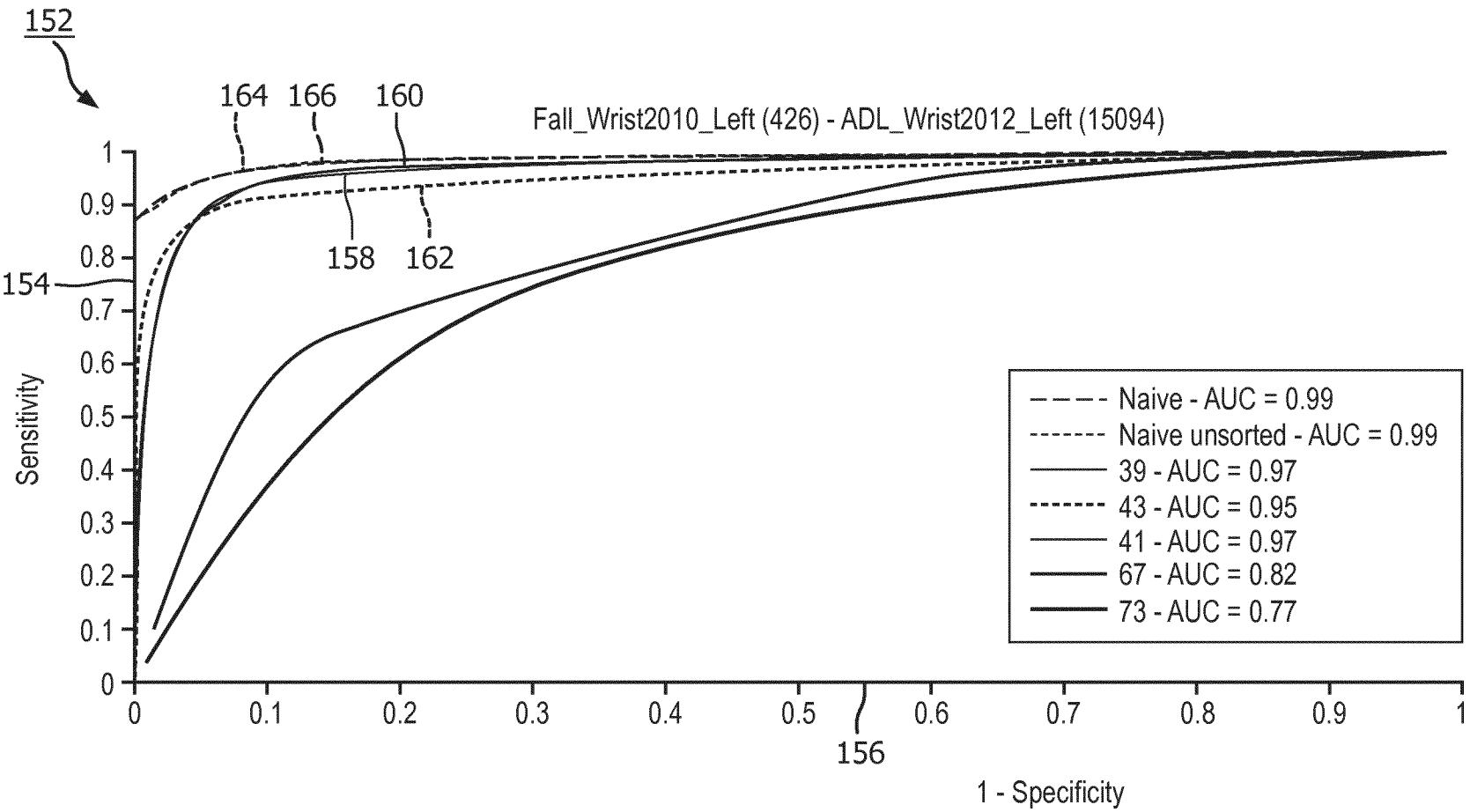
FIG. 7 is a plot diagram that illustrates example receiver operating characteristic curves, in accordance with an embodiment of the invention.

Referring now to FIG. 7, shown is a plot diagram 152 that illustrates an example result for a fall detection system compared to methods that do not account for arm orientation before and after a fall event. The Y-axis 154 corresponds to the sensitivity and the X-axis 156 corresponds to the specificity. The plot diagram 152 plots sensitivity (vertical 154) against 1 minus specificity (horizontal 156) when varying the detection threshold. Sensitivity is the detection probability (fraction of fall events in the data set that get detected). Specificity is 1 minus the probability to raise a false alarm (1 minus fraction of non-fall events that get labeled as fall). So, along the vertical 154 the TP (True Positive) rate is plotted and along the horizontal 156 the FP (False Positive) rate is plotted. (Twice applying "1 minus" cancels the effect.) Curves 158 and 160, which track each other well, correspond to Receiver Operating Characteristics (ROC) curves that reveal two mechanisms of estimating height changes. Curve 162 shows the effect of correcting the height change. Since a low FA rate is to be achieved, the left side of the curve is relevant, and it can be seen that the curve 162 moves leftwards. In this example, the curve 162 does not saturate quickly to 100% detection. The dotted curves 164, 166 show the result when the height change is combined with the orientation before and after the event in a NBC (Naïve Bayesian Classifier). Explaining further, at a high threshold, only a few falls get detected (low y-value), but there are also a few false positives, manifesting as an (operating) point at the lower left corner. With decreasing threshold, more falls will be detected, TP increases, and at some point also more FPs will enter. This leads to the curve to first start raising and at some point to start bending to the right. The more the curve reaches the left upper corner, the better the detector. A designer of the system chooses the threshold. The operating point is set at that threshold where the curve start to leave the y-axis, say at TP=0.6 in FIG. 7 (and hence curve 158 is at TP=0.4). Also evident from FIG. 7 is that curves 164/166 are the best designs, both in reaching the left-upper corner as in TP at 'leaving y-axis' (TP=0.87).

When computing the joint probability, though not shown on the plot diagram 152, 100% accuracy was obtained on this data set. By joint classification, further improvement is indicated, over the naïve approach that ignores (statistical) dependencies between the features. The combination of height change with arm-directions improves detection accuracy.

Figure 8:
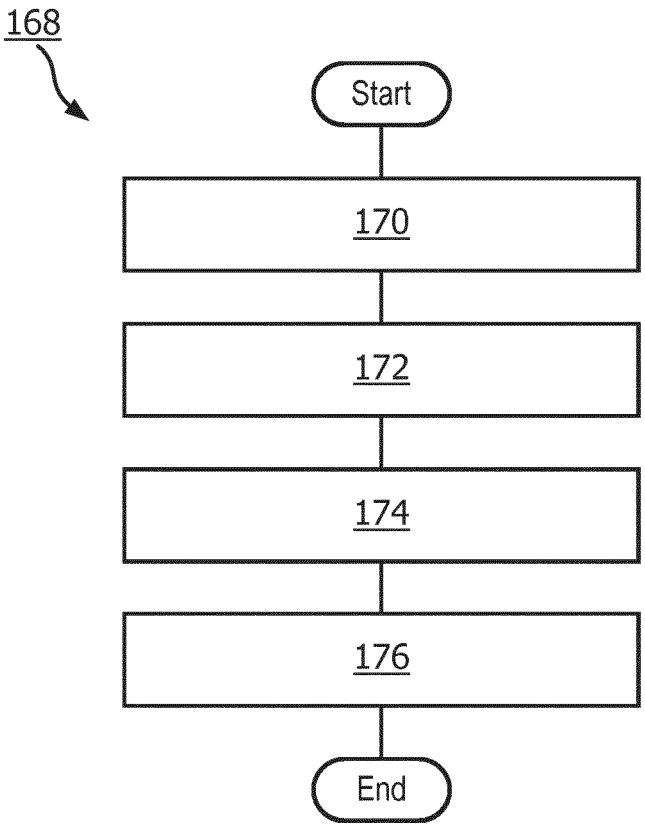
FIG. 8 is a flow diagram that illustrates an example fall detection method, in accordance with an embodiment of the invention.

In view of the description above, it should be appreciated that one embodiment of a computer-implemented, fall detection method, depicted in FIG. 8 and referred to as a method 168 and encompassed between start and end designations, comprises receiving signals comprising wrist height information and arm direction information from the wrist worn device (170); determining a height change of the wrist worn device corrected for a direction of an arm of the subject before and after a suspected fall event based on the received signals (172); providing an alert based on the determined height change (174); and triggering activation of circuitry of a device located external to the wrist worn device based on the alert, the triggering prompting assistance for the subject (176). The circuitry may include dialing functionality of a telephonic device, voice recorder circuitry, visual/audio/tactile alarm circuitry, among other circuitry as explained above. Note that the method 168 includes a classifier function wherein the alert is issued based on a corrected height change determination. In some embodiments, one or more steps may be omitted. In some embodiments, several feature values may be used leading up to the alert issuance, as described above in conjunction with the description of the classifier 31 (FIG. 2), including one or more of impact, height change (in addition to, height change correction), arm direction information, change in arm direction, etc., as described above. Further, wrist height information includes wrist height derived from accelerometer signals (e.g., double integration of accelerometer measurements) and as derived (via Eqn. 1) from an air pressure sensor signal. Note that an air pressure sensor can inform about altitude, though floor level estimation in a house is difficult without reference, due to the fluctuating barometric whether conditions. When estimating from an accelerometer (by double integration), there is no reference height, only the height change since start of integration is estimated. Height at the start of the integration is unknown and cannot be determined from the accelerometer.

Figure 9:
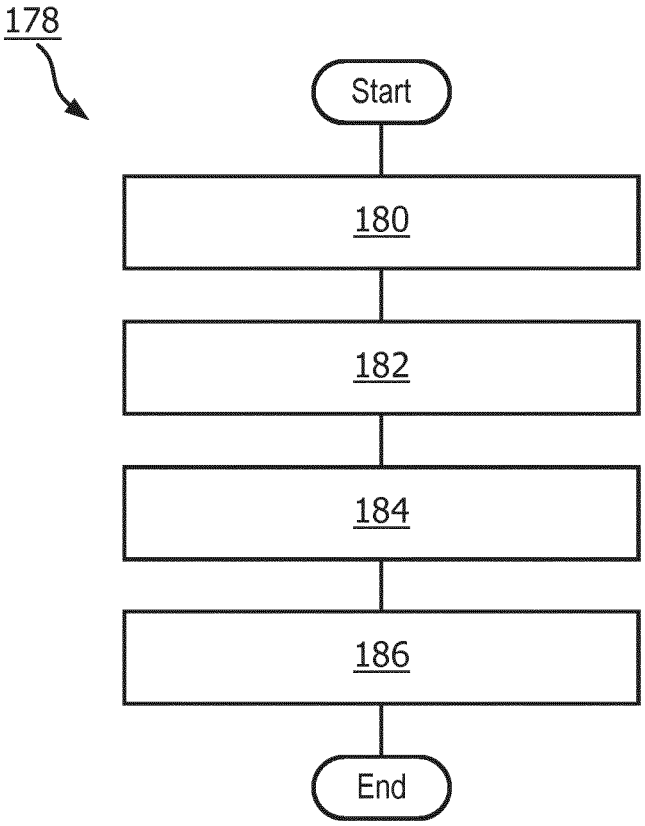
FIG. 9 is a flow diagram that illustrates an example fall detection method, in accordance with an embodiment of the invention.

In view of the description above, it should be appreciated that another embodiment of a computer-implemented, fall detection method, depicted in FIG. 9 and referred to as a method 178 and encompassed between start and end designations, comprises receiving signals comprising arm direction information (180); determining an event involving the subject is a suspected fall event based on at least the arm direction information (182); providing an alert based on the determination (184); and triggering activation of circuitry based on the alert, the triggering prompting assistance for the subject (186). The circuitry may include dialing functionality of a telephonic device, voice recorder circuitry, visual/audio/tactile alarm circuitry, among other circuitry as explained above. Method 176 describes one embodiment of operations of the classifier 31 (FIG. 2), where the trigger for additional processing is based on arm direction information received from a sensory system. In some embodiments, one or more steps may be omitted.

Any process descriptions or blocks in flow diagrams should be understood as representing modules, segments, or portions of code which include one or more executable instructions for implementing specific logical functions or steps in the process, and alternate implementations are included within the scope of the embodiments in which functions may be executed out of order from that shown or discussed, including substantially concurrently or in reverse order, depending on the functionality involved, as would be understood by those reasonably skilled in the art of the present disclosure. In an embodiment, a claim to an apparatus worn proximal to a wrist of a subject is presented, the apparatus comprising: a sensor system; memory comprising instructions; and a processing circuit configured to execute the instructions to: receive signals from the sensor system, the signals comprising arm direction information; determine an event involving the subject is a suspected fall event based on at least the arm direction information; provide an alert based on the determination; and trigger activation of circuitry based on the alert, the trigger prompting assistance for the subject.

In an embodiment, an apparatus claim according to the preceding claim is presented, wherein the processing circuit is further configured to execute the instructions to determine the event involving the subject is a suspected fall event based at least on the arm direction information before and after the suspected fall event.

In an embodiment, an apparatus claim according to any one of the preceding claims is presented, wherein the arm direction information comprises a normalized gravity component along an arm direction.

In an embodiment, an apparatus claim according to any one of the preceding claims is presented, wherein the processing circuit is further configured to execute the instructions to determine a change in direction of the arm based on the arm direction information.

In an embodiment, an apparatus claim according to any one of the preceding claims is presented, wherein a change in direction from upwards to downwards provides a lower likelihood that the event is determined to be a suspected fall event than a change in direction from downwards to upwards.

In an embodiment, an apparatus claim according to any one of the preceding claims is presented, wherein a change in direction exceeding a threshold value after the event provides a higher likelihood that the event is a suspected fall event.

In an embodiment, an apparatus claim according to any one of the preceding claims is presented, wherein the sensor system comprises an accelerometer and the arm direction information comprises accelerometer measurements, and wherein the processing circuit is further configured to execute the instructions to determine an event involving the subject is a suspected fall event based on one or any combination of an amount of acceleration, velocity derived from the accelerometer measurements, or orientation change derived from the accelerometer measurements.

In an embodiment, an apparatus claim according to any one of the preceding claims is presented, wherein the sensor system further comprises any one or a combination of a gyroscope or magnetometer.

In an embodiment, an apparatus claim according to any one of the preceding claims is presented, wherein the signals further comprise additional information, and wherein the processing circuit is further configured to execute the instructions to derive height information for the wrist from the additional information and determine an event involving the subject is a suspected fall event based on a change in the height information.

In an embodiment, an apparatus claim according to any one of the preceding claims is presented, wherein the sensor system comprises an accelerometer and any one or a combination of a gyroscope or an air pressure sensor.

In an embodiment, an apparatus claim according to any one of the preceding claims is presented, wherein the processing circuit is further configured to execute the instructions to determine an event involving the subject is a suspected fall event based on a correction to the change in the height information using the arm direction information.

In an embodiment, an apparatus claim according to any one of the preceding claims is presented, wherein the signals further comprise additional information, and wherein the processing circuit is further configured to execute the instructions to derive height information for the wrist from the additional information and to determine a height change of the wrist corrected for a direction of an arm of the subject before and after a suspected fall event based on the received signals.

In an embodiment, an apparatus claim according to any one of the preceding claims is presented, wherein the processing circuit is further configured to execute the instructions to determine whether an arm moves from upwards to downwards or downwards to upwards based on the arm direction information.

In an embodiment, an apparatus claim according to any one of the preceding claims is presented, wherein the processing circuit is further configured to execute the instructions to: correct the height change by determining an increase in height when the arm is determined to move from downwards before the suspected fall event to upwards after the suspected fall event; or correct the height change by determining a decrease in height when the arm is determined to move from upwards before the suspected fall event to downwards after the suspected fall event.

In an embodiment, an apparatus claim according to any one of the preceding claims is presented, wherein the processing circuit is configured to execute the instructions to determine the height change correction based on a summation of the height change of the wrist before correction, a first correction term corresponding to the arm direction before the suspected fall event, and a second correction term corresponding to the arm direction after the suspected fall event, the first and second correction terms based on the arm direction information and an arm length, wherein the arm length is estimated or received as input.

In an embodiment, an apparatus claim according to any one of the preceding claims is presented, wherein the sensor system comprises an air pressure sensor and the additional information comprises pressure information, and wherein the processing circuit is further configured to execute the instructions to derive a height change of the wrist based on the pressure information.

In an embodiment, an apparatus claim according to any one of the preceding claims is presented, wherein the sensor system comprises an accelerometer and the additional information comprises accelerometer measurements, and wherein the processing circuit is further configured to execute the instructions to derive a height change of the wrist based on the accelerometer measurements.

In an embodiment, an apparatus claim according to any one of the preceding claims is presented, further comprising a communications circuit, wherein the processing circuit is configured to execute the instructions to provide the alert based on the corrected height change exceeding a threshold amount by causing the communications unit to communicate the alert to one or more devices.

In an embodiment, a claim to a system for detecting a suspected fall event involving a subject is presented, the system comprising: memory comprising instructions; and one or more processors configured to execute the instructions to: receive signals comprising arm direction information; determine an event involving the subject is a suspected fall event based on at least the arm direction information; provide an alert based on the determination; and trigger activation of circuitry based on the alert, the trigger prompting assistance for the subject.

In an embodiment, a claim to a computer-implemented method for detecting a suspected fall event involving a subject is presented, the method comprising: receiving signals comprising arm direction information; determining an event involving the subject is a suspected fall event based on at least the arm direction information; providing an alert based on the determination; and triggering activation of circuitry based on the alert, the trigger prompting assistance for the subject.

In an embodiment, a claim to a non-transitory, computer readable medium comprising instructions that, when executed by one or more processors, causes the one or more processors to: receive signals comprising arm direction information; determine an event involving the subject is a suspected fall event based on at least the arm direction information; provide an alert based on the determination; and trigger activation of circuitry based on the alert, the trigger prompting assistance for the subject.

Note that various combinations of the disclosed embodiments may be used, and hence reference to an embodiment or one embodiment is not meant to exclude features from that embodiment from use with features from other embodiments. For instance, though height change determinations are primarily described above in the context of air pressure signals and the use of equation Eqn. 1 to derive height change, some embodiments may use the accelerometer signals to derive height change (which may then be corrected using arm direction). Though the use of double integration is described above as one embodiment for height change determinations, variants may be used. For instance, in one embodiment, the classifier 31 estimates the velocity of a device in a vertical direction by obtaining measurements of the acceleration acting in a vertical direction on the wearable device 12 using the accelerometer sensor 22B, using a first filter to remove acceleration due to gravity from the obtained measurements to give an estimate of the acceleration acting in a vertical direction due to motion of the device 12, integrating the estimate of the acceleration acting in a vertical direction due to motion of the device to give an estimate of vertical velocity and using a second filter to remove offset and/or drift from the vertical velocity to give a filtered vertical velocity. For instance, the accelerometer 22B measures acceleration in three dimensions and outputs a respective signal for each of the measurement axes. The accelerometer measurements are provided to the classifier 31 to process the measurements to identify the component of acceleration acting in the vertical direction. This processing can be performed in a number of different ways. For an accurate estimation of the vertical acceleration to made, it is desirable to obtain an accurate estimation of the orientation of the accelerometer 22B so that a coordinate transformation (rotation) can be applied to the accelerometer measurements. This orientation estimation can be obtained using one of the sensors 22N configured as a gyroscope and/or magnetometer, wherein the output from these sensors, possibly together with that from the accelerometer 22B, is used to determine the coordinate transformation (rotation) to be applied to the accelerometer measurements.

After coordinate transformation, the vertical component of acceleration can easily be identified. The classifier 31 estimates the acceleration due to gravity in the vertical component of acceleration using a first filter (not shown). In one embodiment, the classifier 31 applies a non-linear filter to the vertical component of acceleration to provide an estimate for gravity. The non-linear filter may be a median filter. As known, a median filter processes each sample in the input signal in turn, replacing each sample with the median of a number of neighboring samples. The number of samples considered at each stage is determined by the window size of the filter. A typical half window size can be 1.6 seconds (so the window encompasses 1.6 seconds worth of samples before the current sample and 1.6 seconds worth of samples after the current sample). In some embodiments, the non-linear filter may be a recursive median filter, a weighted median filter, or a mode filter. The estimate of the acceleration due to gravity is provided to addition/subtraction functionality (not shown) in the classifier 31 where it is subtracted from the vertical component of acceleration to leave the acceleration in the vertical direction due to the motion of the wearable device 12. The signal representing the vertical acceleration due to the motion of the wearable device 12 is then integrated with respect to time to give an estimate of the velocity in the vertical direction. The initial velocity value input to integration functionality (not shown) in the classifier is unknown, but is typically assumed to be zero. In any case, the next filtering stage (described further below) removes offset and drift in the vertical velocity signal, and therefore the initial velocity component (if non-zero) will be substantially removed. The signal representing the vertical velocity is provided to filter functionality in the classifier 31, which applies a filter to the vertical velocity signal to estimate the offset and any drift components present in that signal. The result of this filtering is a signal representing the fluctuations of the monotonous (i.e. offset and drift) component. The classifier 31 applies a non-linear filter to the vertical velocity signal to remove the offset and drift present in the signal.

To derive the height change information, the offset and drift free vertical velocity signal may be integrated with respect to time to give the height or change in height of the wearable device 12. The initial position value will typically be unknown, but where the result of the integration is used to determine a change in the height, knowledge of the initial position is unnecessary. If it is desired to calculate the actual height, some calibration or initiation will be required. The output of integration functionality of the classifier 31 provides the estimate of height. A change in height, as used to detect a fall or a rise (standing-up), results from computing the difference between the estimated heights at two time instants, for example at the current time instant and at a couple of (e.g. 2) seconds ago. There are multiple ways in which the change in height can be used in the classifier for detecting a fall. For example, it can be determined whether the computed change in height exceeds a (downwards) threshold. A more sophisticated example is to use the size of the change itself in a probability metric. Additional information on velocity determinations and height change determinations based on the accelerometer signals may be found in U.S. Patent Publication Nos. 20140156216 and 20150317890, also referenced above.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical medium or solid-state medium supplied together with or as part of other hardware, but may also be distributed in other forms. Any reference signs in the claims should be not construed as limiting the scope.

The invention claimed is:

1. An apparatus worn proximal to a wrist of a subject, the apparatus comprising:

a sensor system;

a memory comprising instructions; and a processing circuit configured to execute the instructions to:

receive signals from the sensor system, the signals comprising arm direction information;

determine an event involving the subject is a suspected fall event based on at least the arm direction information;

determine whether the suspected fall event is likely to be an actual fall event based upon a corrected height change of an arm of the subject;

provide an alert based on the determination that the suspected fall event is likely to be an actual fall event; and trigger activation of circuitry based on the alert, the trigger prompting assistance for the subject.

2. The apparatus of claim 1, wherein the processing circuit is further configured to execute the instructions to determine the event involving the subject is the suspected fall event based at least on the arm direction information before and after the suspected fall event.

3. The apparatus of claim 1, wherein the arm direction information comprises a normalized gravity component along an arm direction of the subject.

4. The apparatus of claim 1, wherein the processing circuit is further configured to execute the instructions to determine a change in direction of the arm of the subject based on the arm direction information.

5. The apparatus of claim 1, wherein the sensor system further comprises:

an accelerometer, the arm direction information comprises accelerometer measurements, and the processing circuit is further configured to execute the instructions to determine an event involving the subject is the suspected fall event based on one or any combination of an amount of acceleration, a velocity derived from the accelerometer measurements, or an orientation change derived from the accelerometer measurements.

6. The apparatus of claim 1, wherein the sensor system further comprises:

any one or a combination of a gyroscope or a magnetometer.

7. The apparatus of claim 1, wherein the signals further comprise additional information, and the processing circuit is further configured to execute the instructions to derive height information for the wrist from the additional information and determine an event involving the subject is the suspected fall event based on a change in the height information.

8. The apparatus of claim 1, wherein the sensor system further comprises:

an accelerometer; and any one or a combination of a gyroscope or an air pressure sensor.

9. The apparatus of claim 1, wherein the processing circuit is further configured to execute the instructions to determine an event involving the subject is the suspected fall event based on a correction to the change in the height information using the arm direction information.

10. The apparatus of claim 1, wherein the signals further comprise additional information, and the processing circuit is further configured to:

execute the instructions to derive height information for the wrist from the additional information and determine a height change of the wrist corrected for a direction of an arm of the subject before and after the suspected fall event based on the received signals.

11. An apparatus worn proximal to a wrist of a subject, the apparatus comprising:

a sensor system;

a memory comprising instructions; and a processing circuit configured to execute the instructions to:

receive signals from the sensor system, the signals comprising arm direction information;

determine an event involving the subject is a suspected fall event based on at least the arm direction information;

provide an alert based on the determination; and trigger activation of circuitry based on the alert, the trigger prompting assistance for the subject execute instructions to determine a height change correction based on a summation of a height change of the wrist before correction, a first correction term corresponding to an arm direction before the suspected fall event, and a second correction term corresponding to the arm direction after the suspected fall event, the first correction term and the second correction term based on the arm direction information and an arm length, wherein the arm length is estimated or received as input.

12. The apparatus of claim 1, wherein the sensor system further comprises:

an air pressure sensor, the additional information comprises pressure information, and the processing circuit is further configured to execute the instructions to derive a height change of the wrist based on the pressure information.

13. The apparatus of claim 1, wherein the sensor system further comprises:

an accelerometer, the additional information comprises accelerometer measurements, and the processing circuit is further configured to execute the instructions to derive a height change of the wrist based on the accelerometer measurements.

14. The apparatus of claim 1, further comprising:

a communications circuit, wherein the processing circuit is configured to execute the instructions to provide the alert based on the corrected height change exceeding a threshold amount by causing the communications unit to communicate the alert to one or more devices.

15. A computer-implemented method for detecting a suspected fall event involving a subject, the computer-implemented method comprising:

receiving signals comprising arm direction information; and determining an event involving the subject is the suspected fall event based on at least the arm direction information;

determining whether the suspected fall event is likely to be an actual fall event based upon a corrected height change of an arm of the subject providing an alert based on the determination that the suspected fall event is likely to be an actual fall event; and triggering activation of circuitry based on the alert, the trigger prompting assistance for the subject.

* * * * *